US010047705B2

(12) United States Patent
Dudar et al.

(10) Patent No.: US 10,047,705 B2
(45) Date of Patent: Aug. 14, 2018

(54) SYSTEMS AND METHODS FOR REDUCING VEHICLE EVAPORATIVE EMISSIONS

(71) Applicant: Ford Global Technologies, LLC, Dearborn, MI (US)

(72) Inventors: Aed M. Dudar, Canton, MI (US); Dennis Seung-Man Yang, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 23 days.

(21) Appl. No.: 15/068,839

(22) Filed: Mar. 14, 2016

(65) Prior Publication Data

US 2017/0260914 A1 Sep. 14, 2017

(51) Int. Cl.

| | |
|---|---|
| ***F02M 25/08*** | (2006.01) |
| ***F02M 35/02*** | (2006.01) |
| ***F02D 41/00*** | (2006.01) |
| *F02D 41/04* | (2006.01) |

(52) U.S. Cl.

CPC ..... *F02M 35/0218* (2013.01); *F02D 41/0032* (2013.01); *F02M 25/089* (2013.01); *F02M 25/0836* (2013.01); *F02M 25/0854* (2013.01); *F02D 41/042* (2013.01)

(58) Field of Classification Search

CPC .. F02D 41/004; F02D 41/2409; F02D 41/032; F02D 19/0673; F02D 19/0676; F02D 19/0681; F02M 25/0836; F02M 25/0854; F02M 25/089; F02M 25/0809; F02M 25/0818; F02M 35/0218

USPC ..... 123/516, 519, 520, 459; 73/114.39

See application file for complete search history.

(56) References Cited

U.S. PATENT DOCUMENTS

| | | | | |
|---|---|---|---|---|
| 8,371,273 | B2 | 2/2013 | Ulrey et al. | |
| 8,590,514 | B2 | 11/2013 | Pursifull | |
| 9,050,885 | B1 | 6/2015 | Dudar et al. | |
| 2001/0027682 | A1* | 10/2001 | Takagi | F02M 25/0818 73/114.41 |
| 2001/0054415 | A1* | 12/2001 | Hanai | F02M 25/0809 123/520 |
| 2002/0046609 | A1* | 4/2002 | Ito | F02M 25/0809 73/700 |

(Continued)

OTHER PUBLICATIONS

Dudar, Aed M., "System and Methods for Fuel Vapor Canister Flow," U.S. Appl. No. 14/843,371, filed Sep. 2, 2015, 50 pages.

*Primary Examiner* — Hai Huynh
*Assistant Examiner* — Gonzalo Laguarda
(74) *Attorney, Agent, or Firm* — Julia Voutyras; McCoy Russell LLP

(57) ABSTRACT

Methods and systems are provided for managing fuel vapor in a vehicle evaporative emissions system configured with a fuel vapor canister for capturing and storing vapors from a vehicle fuel tank. In one example, a three-way valve is positioned between the fuel vapor canister and atmosphere, and may function during engine-off conditions to direct fuel tank vapors through the fuel vapor canister where they may be adsorbed, and then to an intake manifold of the engine where a second adsorbent for capturing and storing fuel vapors is positioned. In this way, fuel vapors that are not adsorbed by the fuel vapor canister, or fuel vapors that are freed from the canister during engine-off conditions may be routed to the second adsorbent prior to exiting to atmosphere, thus reducing undesired bleed emissions.

18 Claims, 8 Drawing Sheets

(56) References Cited

U.S. PATENT DOCUMENTS

| | | | | |
|---|---|---|---|---|
| 2006/0278201 | A1* | 12/2006 | Nakamura | F02M 25/0818 123/519 |
| 2007/0012298 | A1* | 1/2007 | Nakamura | F02M 25/0836 123/509 |
| 2007/0227515 | A1* | 10/2007 | Uchida | F02M 25/089 123/520 |
| 2009/0107472 | A1* | 4/2009 | Makino | F02M 25/0836 123/520 |
| 2014/0026866 | A1* | 1/2014 | Pifher | F02M 33/02 123/520 |
| 2014/0216421 | A1 | 8/2014 | Pifher et al. | |

* cited by examiner

SYSTEMS AND METHODS FOR REDUCING VEHICLE EVAPORATIVE EMISSIONS

FIELD

The present description relates generally to methods and systems for controlling a vehicle engine to reduce undesired evaporative emissions.

BACKGROUND/SUMMARY

Vehicles sold in North America are required to adsorb refueling, diurnal and running loss vapors into a carbon canister. When the canister is loaded with fuel vapor, the contents may be purged to engine intake using engine intake vacuum to draw fresh air though the canister, desorbing bound hydrocarbons. Strict regulations regulate the performance of evaporative emissions systems.

In a typical canister purge operation, a canister purge valve coupled between the engine intake and the fuel canister is opened, allowing for intake manifold vacuum to be applied to the fuel canister. Simultaneously, a canister vent valve coupled between the fuel canister and atmosphere is opened, allowing for fresh air to enter the canister. This configuration facilitates desorption of stored fuel vapors from the adsorbent material in the canister, regenerating the adsorbent material for further fuel vapor adsorption.

Hybrid vehicles, and other vehicles configured to operate with minimal or no intake vacuum may have limited opportunities to purge the fuel vapor canister. Even in standard engine vehicles, the fuel vapor canister may not be completely cleared of contents following a purge, as the airflow through the canister is not uniform. If the vehicle is parked in a hot or sunny location over a diurnal cycle, the retained hydrocarbons may desorb from the canister and result in bleed emissions.

Bleed emissions may be limited by adding a secondary "bleed" canister to capture desorbed hydrocarbons. However, this adds additional cost, weight, and packaging to the vehicle. Further, in hybrid vehicles, a highly restrictive bleed canister may impede fuel tank depressurization prior to a refueling sequence, and/or may impede refueling efforts due to pressure buildup during refueling resulting in premature shutoffs of the refueling pump.

US patent application U.S. Pat. No. 9,050,885 teaches managing bleed emissions in plug-in hybrid electric vehicles. In one example, during engine-off conditions with the plug-in hybrid electric vehicle coupled to an external power source, the fuel vapor canister is cooled based on ambient temperature. For example, the canister may be cooled by activating cooling fans, and/or by circulating coolant or refrigerant through a circuit coupled to the fuel vapor canister. During conditions where ambient temperature is high, cooling the canister may reduce bleed emissions resulting from an increase in fuel vapor canister temperature. However, the inventors herein have recognized potential issues with such systems. As one example, the method is specific to plug-in hybrid electric vehicles, as cooling the canister in vehicles that are not coupled to an external power supply is not desirable due to the battery power necessary to conduct such an operation. As such, other systems and methods are desired wherein bleed emissions may be reduced without the use of costly secondary bleed canisters that may add cost and weight to the vehicle, and which may impede refueling efforts.

Thus, the inventors have herein developed systems and methods to at least partially address the above issues. In one example, a method is provided, comprising coupling a fuel tank that supplies fuel to an engine to an intake manifold of the engine during engine-off conditions, wherein an engine-off condition includes one or more of a key-off event, or a condition wherein the vehicle is powered solely by energy provided by an onboard energy storage device.

As one example, the method includes adsorbing fuel tank vapors in a fuel vapor canister positioned in an evaporative emissions system of the vehicle, and wherein coupling the fuel tank to the intake manifold during engine-off conditions routes fuel tank vapors to the fuel vapor canister to be adsorbed therein, prior to being routed to the intake manifold. In one example, the method further includes adsorbing fuel tank vapors in an adsorbent material positioned in the engine intake manifold, and wherein coupling the fuel tank to the intake manifold during engine-off conditions reduces bleed emissions from the fuel vapor canister. In this way, by coupling the fuel tank to the intake manifold during engine-off conditions, bleed emissions may be reduced, without the use of a second bleed canister that adds cost and weight to the vehicle, and which may impede refueling efforts.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
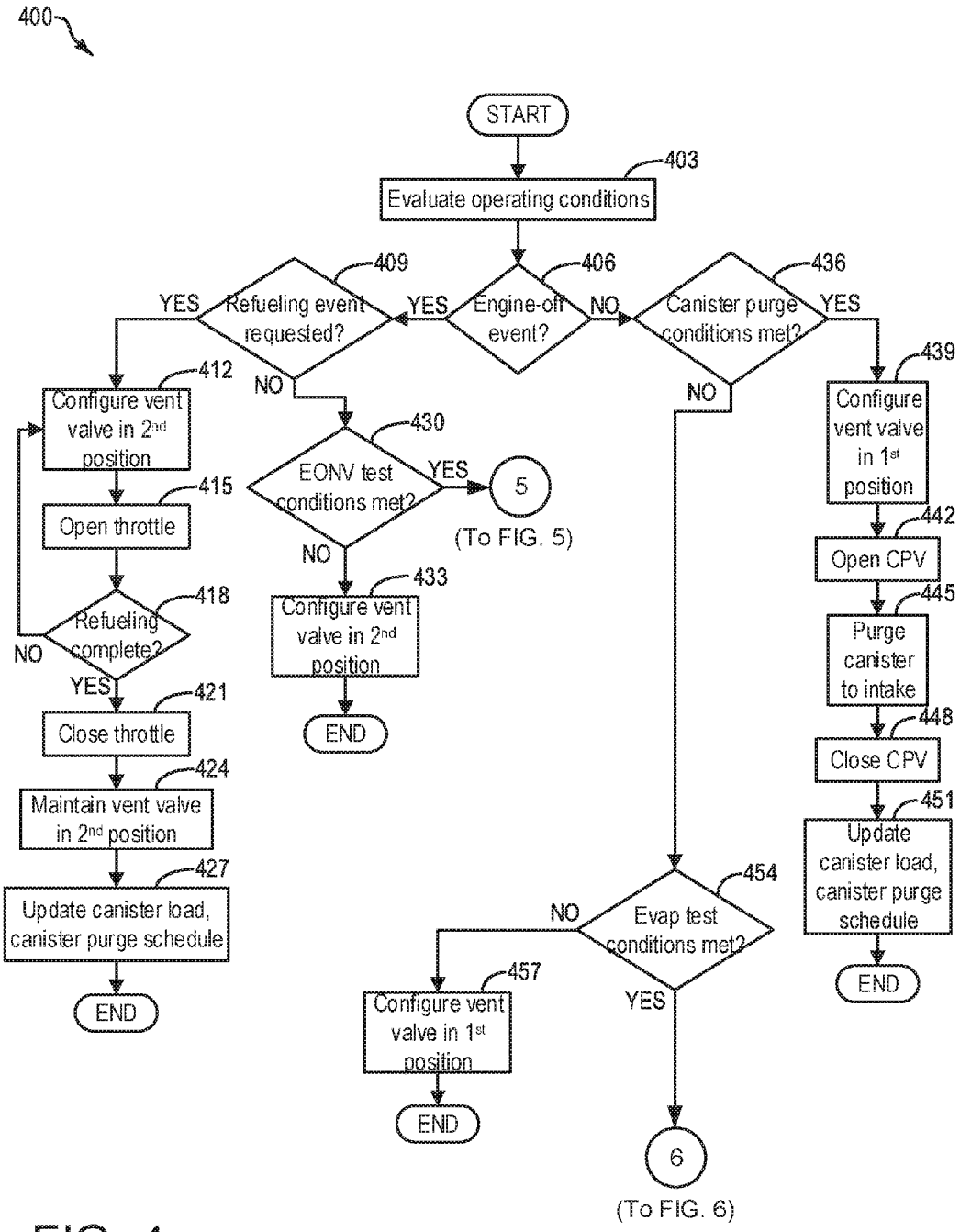
FIG. 4 shows a flowchart for a high level example method for capturing and storing fuel tank vapors, and purging stored fuel tank vapors to the intake manifold.
Figure 5:
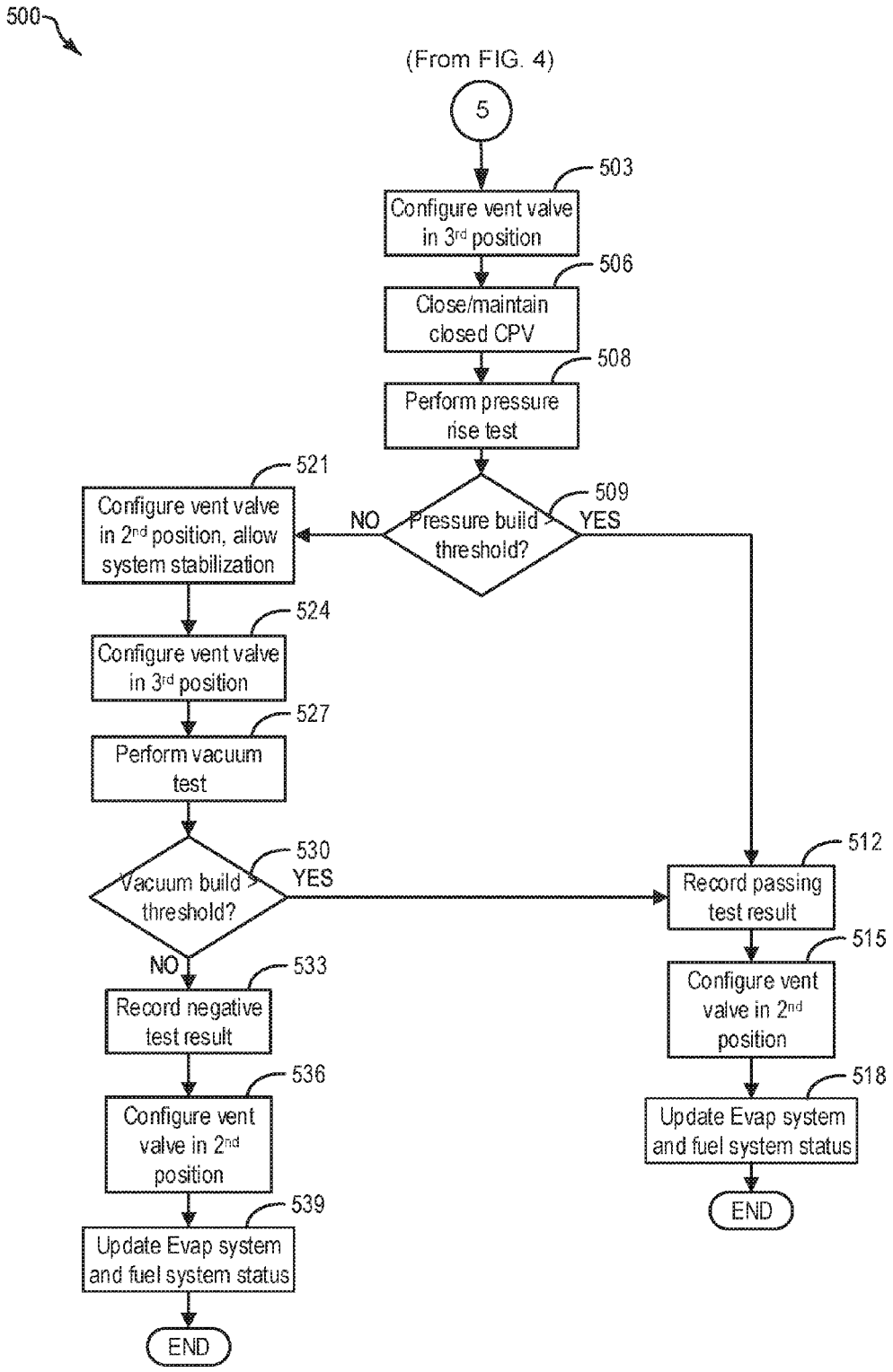
FIG. 5 shows a flowchart for a high level example method continuing from FIG. 4 for conducting an engine-off test for undesired evaporative emissions.

This detailed description relates to systems and methods for managing fuel vapor in an evaporative emissions system. Specifically, the description relates to routing fuel tank vapors from a fuel tank through a fuel vapor canister and to an engine intake manifold during engine-off conditions. The evaporative emissions system may be included in a hybrid vehicle, such as the hybrid vehicle depicted in FIG. 1. The vehicle may include an engine system and fuel system coupled to the evaporative emissions system, as shown in FIG. 2. The evaporative emissions system may include a fuel vapor canister coupled to a fuel tank such that fuel vapor may be discharged from the fuel tank and stored in the vapor canister without entering the atmosphere. FIGS. 3A-3D show depictions of an example fuel vapor canister and a system of conduits and valves for controlling the routing of fuel tank vapors based on operating conditions. A method for operating a vehicle evaporative emissions system based on engine operating conditions is depicted in FIG. 4. The method includes differentially routing fuel tank vapors depending on whether the vehicle engine is in operation, or not in operation. The fuel system and evaporative emissions system may be periodically checked for undesired evaporative emissions. A method for conducting an evaporative emissions test diagnostic procedure while the engine is not operating is depicted in FIG. 5. Alternatively, an evaporative emissions test diagnostic procedure may be conducted while the engine is in operation, according to the method depicted in FIG. 6. FIG. 7 shows a timeline for managing fuel vapor in an evaporative emissions system using the methods of FIG. 4-6.

Figure 1:
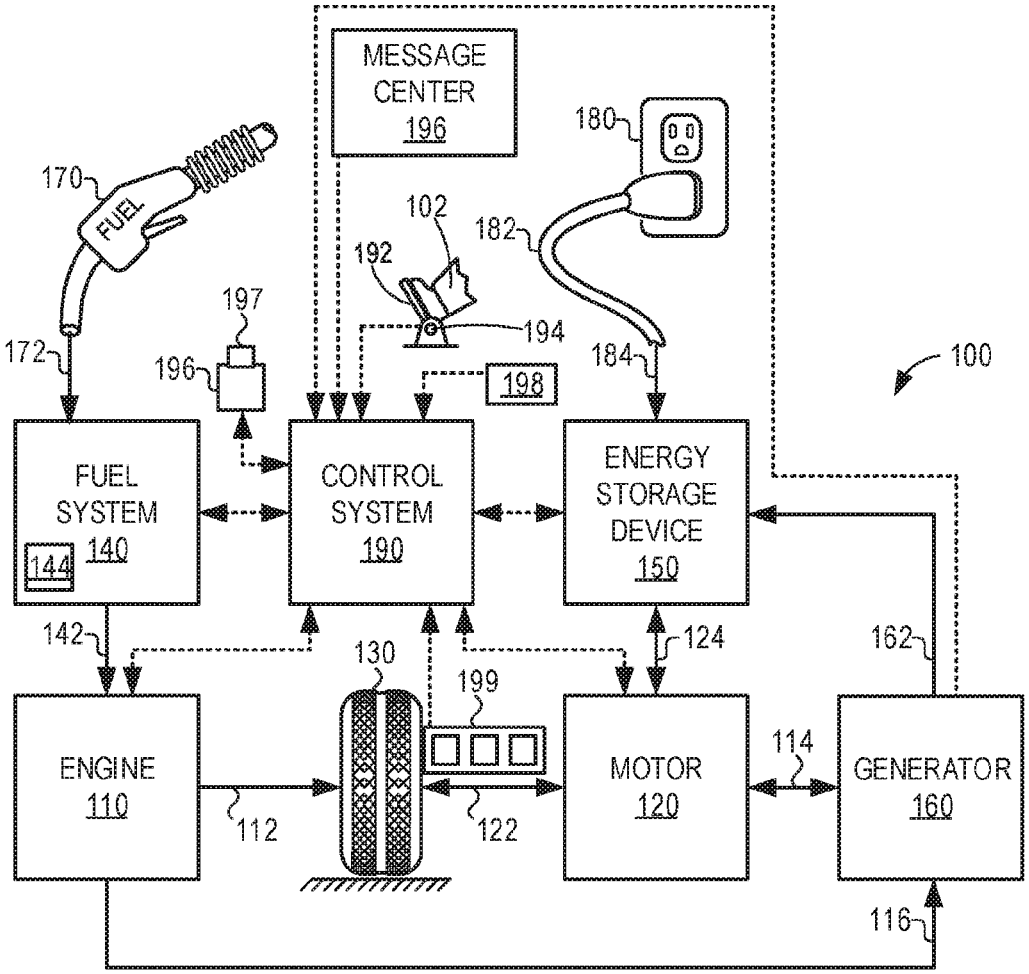
FIG. 1 schematically shows an example vehicle propulsion system.
Figure 2:
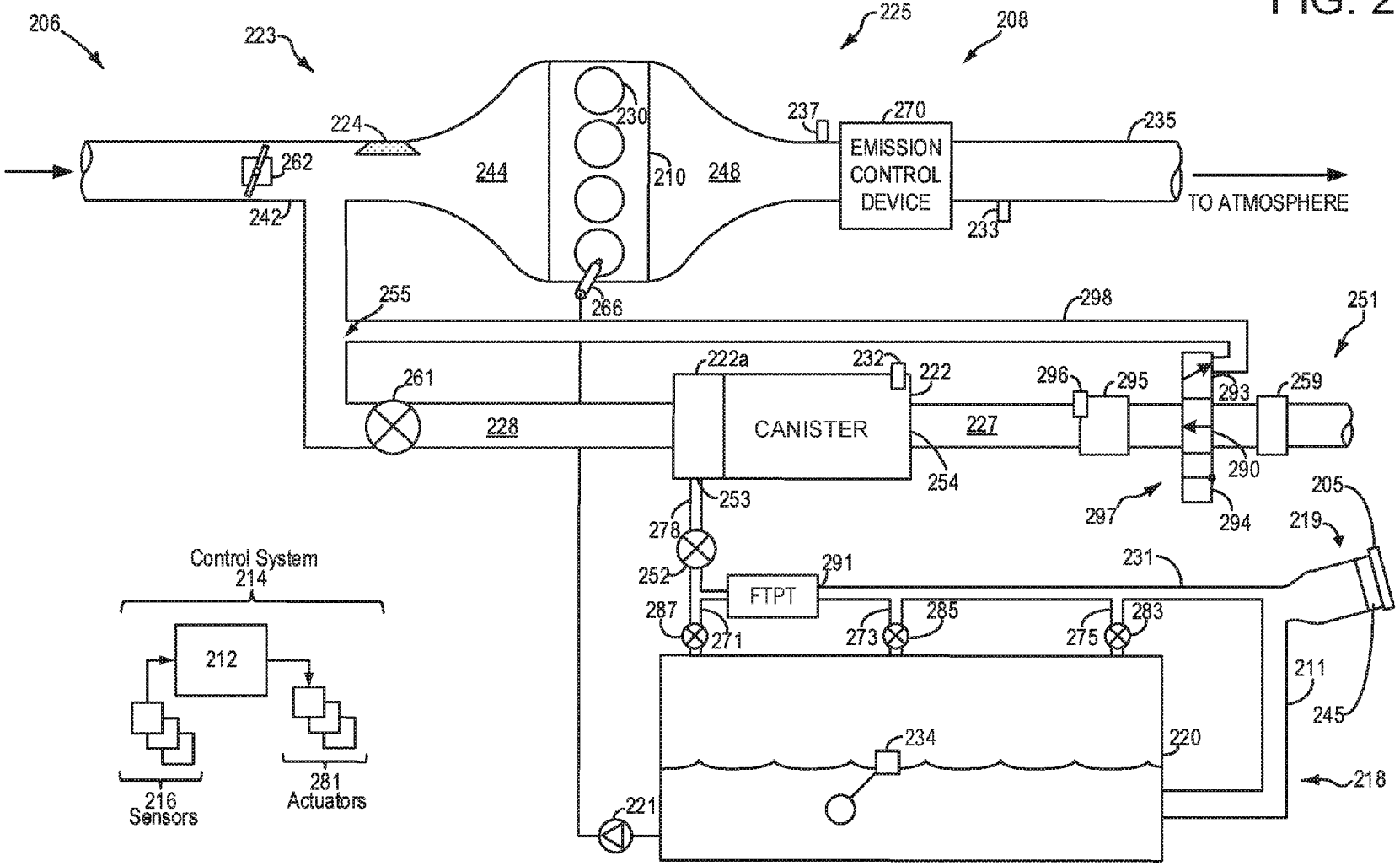
FIG. 2 schematically shows an example vehicle system with a fuel system and an evaporative emissions system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV). While vehicle propulsion system 100 illustrates a HEV, it should be understood that this example illustration is not meant to be limiting, and the methods and systems depicted herein may be applied to a non-hybrid vehicle without departing from the scope of the present disclosure.

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. For example, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

An air intake system hydrocarbon trap (AIS HC) 224 may be placed in the intake manifold of engine 210 to adsorb fuel vapors emanating from unburned fuel in the intake manifold, puddled fuel from one or more fuel injectors with undesired fuel outflow, and/or fuel vapors in crankcase ventilation emissions during engine-off periods. Furthermore, as will be described in more detail below, the AIS HC may capture and store fuel tank vapors that are not adsorbed by a fuel vapor canister 222 during engine-off conditions, by routing the vapors through the fuel vapor canister 222 and then to the engine intake manifold 244 where the AIS HC 224 is positioned. The AIS HC may include a stack of consecutively layered polymeric sheets impregnated with HC vapor adsorption/desorption material. Alternately, the adsorption/desorption material may be filled in the area between the layers of polymeric sheets. The adsorption/desorption material may include one or more of carbon, activated carbon, zeolites, or any other HC adsorbing/desorbing materials. When the engine is operational causing an intake manifold vacuum and a resulting airflow across the AIS HC, the trapped vapors may be passively desorbed from the AIS HC and combusted in the engine. Thus, during engine operation, intake fuel vapors are stored and desorbed from AIS HC 224. In addition, fuel vapors stored during an engine shutdown can also be desorbed from the AIS HC during engine operation. In this way, AIS HC 224 may be continually loaded and purged, and the trap may reduce evaporative emissions from the intake passage even when engine 210 is shut down.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. All the injectors in the example shown in FIG. 2 inject fuel directly into each cylinder (i.e., direct injection), however it should be understood that other fuel injector configurations may be applied to engine system 208, including injecting fuel into or against an intake valve of each cylinder (i.e., port injection). It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 (fuel vapor adsorbent bed) via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. The fuel tank 220 may be coupled to vapor canister adsorbent buffer 222*a* at a load port 253. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere or the engine intake manifold 244 may be regulated by a three-way vent valve 297 coupled within vent line 227. Three-way vent valve may include a first position 290, enabling the selective coupling of a fuel vapor canister adsorbent bed 222 to atmosphere, the adsorbent bed 222 coupled to canister vent port 254. Three-way vent valve 297 may further include a second position 293, enabling the selective coupling of fuel vapor canister adsorbent bed 222 to engine intake manifold 244, via vapor line 298. Vapor line 298 may couple to the canister vent port 254 to the engine intake manifold 244 via a junction 255 between canister purge valve 261 and engine intake manifold 244. Three-way vent valve 297 may further include a third position 294, enabling the sealing of vent line 227 from atmosphere and preventing the coupling of vent line 227 to engine intake manifold 244 via vapor line 298. As will be described below, three-way valve 297 may be used to selectively manage fuel vapors in evaporative emissions system 251 based on engine operating conditions.

In some examples, vehicle system 206 may include a fuel tank isolation valve 252 (FTIV) for controlling venting of fuel tank 220 with the atmosphere and/or the engine intake manifold 244. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere, routed through the fuel vapor canister 222 to the engine intake manifold 244 via vapor line 298, or purged to engine intake system 223 via canister purge valve 261. However, in other examples, FTIV 252 may not be included.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 (when included) while closing canister purge valve (CPV) 261, and configuring three-way valve 297 in a second position 293 to route refueling vapors through vapor adsorbent 222 for adsorption and then to intake manifold 244 without being routed through purge valve 261. In such an example, an air intake throttle 262 may be commanded open to facilitate air flow during refueling, and may thus prevent premature shutoffs of a refueling dispensing pump.

As another example, the fuel system may be operated in a refueling mode (e.g., when fuel tank refueling is requested by a vehicle operator), wherein the controller 212 may open isolation valve 252 (when included), while maintaining canister purge valve 261 closed, and configuring three-way valve in a second position 293 to depressurize the fuel tank before allowing enabling fuel to be added therein. As such, isolation valve 252 (when included) may be kept open during the refueling operation to allow refueling vapors to be stored in the canister. After refueling is completed, the isolation valve (when included) may be closed.

As yet another example, the fuel system may be operated in a canister purging mode (e.g., after an emission control device light-off temperature has been attained and with the engine running), wherein the controller 212 may open canister purge valve 261 while closing isolation valve 252 (when included) and commanding three-way valve 297 in the first position 290. Herein, the vacuum generated by the intake manifold of the operating engine may be used to draw fresh air through vent line 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold. In another example, wherein FTIV 252 is not included, controller 212 may similarly open canister purge valve 261 and command three-way valve 297 in the first position 290. Herein, vacuum generated by the intake manifold of the operating engine may be used to route vapors from fuel tank 220 through purge valve 261, and may additionally be used to draw fresh air through vent line 227 and through fuel vapor canister 222 to route desorbed vapors from vapor adsorbent 222 through purge valve 261, to the engine for combustion.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 291, and canister temperature sensor 232. Exhaust gas sensor 237 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Other sensors such as pressure, temperature, and composition sensors may be coupled to various locations in the vehicle system 206. As another example, the actuators may include fuel injector 266, throttle 262, fuel tank isolation valve 252, canister purge valve 261, three-way vent valve 297, and refueling lock 245. The control system 214 may include a controller 212. The controller may receive input data from the various sensors, process the input data, and trigger the actuators in response to the processed input data based on instruction or code programmed therein corresponding to one or more routines. Example control routines are described herein with regard to FIGS. 4-6.

In some examples, the controller may be placed in a reduced power mode or sleep mode, wherein the controller maintains essential functions only, and operates with a lower battery consumption than in a corresponding awake mode. For example, the controller may be placed in a sleep mode following a vehicle-off event in order to perform a diagnostic routine at a duration after the vehicle-off event. The controller may have a wake input that allows the controller to be returned to an awake mode based on an input received from one or more sensors. For example, the opening of a vehicle door may trigger a return to an awake mode.

Evaporative emissions detection routines may be intermittently performed by controller 212 on fuel system 218 to confirm that the fuel system is not degraded. As such, evaporative emissions detection routines may be performed while the engine is off (engine-off evaporative emissions test) using engine-off natural vacuum (EONV) generated due to a change in temperature and pressure at the fuel tank following engine shutdown and/or with vacuum supplemented from a vacuum pump. Alternatively, evaporative emissions detection routines may be performed while the engine is running by operating a vacuum pump and/or using engine intake manifold vacuum. Evaporative emissions tests may be performed by an evaporative level check monitor (ELCM) 295 communicatively coupled to controller 212. ELCM 295 may be coupled in vent 227, between canister 222 and the atmosphere. ELCM 295 may include a vacuum pump for applying negative pressure to the fuel system when administering an evaporative emissions test. In some embodiments, the vacuum pump may be configured to be reversible. In other words, the vacuum pump may be configured to apply either a negative pressure or a positive pressure on the fuel system. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, fuel system degradation may be diagnosed. However, in some examples, as described below, an ELCM may not be included in the vehicle system.

Turning to FIGS. 3A-3D, an evaporative emissions system 351 is shown in various conformations. Evaporative emissions system 351 comprises a fuel vapor canister 322 comprised of adsorbent bed 322*b* and a fuel vapor adsorbent buffer 322*a*, wherein the buffer adsorbent is substantially smaller than the canister adsorbent. Fuel vapor canister adsorbent buffer 322*a* is coupled to fuel tank (not shown) via load conduit 378, the load conduit coupling to load port 333.

A three-way valve 397 may be operable to direct air/vapor flow, based on the position of the valve. For example, when valve 397 is in a first position 390, as indicated for example in FIG. 3A and FIG. 3B, vent line segment 327*a* may be coupled to vent line segment 327 such that canister vent port 354 may be coupled to atmosphere. Alternatively, when three-way valve 397 is in a second position 393, as indicated for example in FIG. 3C, vent segment 327 may be coupled to vapor line 398, such that canister vent port 354 may couple to engine intake via purge line segment 328, where vapor line 398 connects to purge line segment 328 at junction 355, positioned between canister purge valve 361 and engine intake. In still another example, when three-way valve 397 is positioned in a third position 394, vent line segment 327 may be sealed from vent line segment 327*a* and atmosphere, as indicated in FIG. 3D. Further, positioning three-way valve in the third position prevents vent line segment 327 from coupling to vapor line 398. In such an example, by closing canister purge valve 261, purge line segment 328*a* may be sealed from purge line segment 328, thus sealing fuel vapor canister 322 and the fuel tank from atmosphere and from engine intake. As will be described in further detail below with regard to FIGS. 3A-3D, and the methods described in detail in FIGS. 4-6, fuel tank vapors may be effectively managed in evaporative emissions system 351 by selectively regulating three-way valve 397 and canister purge valve 361 based on engine operating conditions.

Figure 3A:
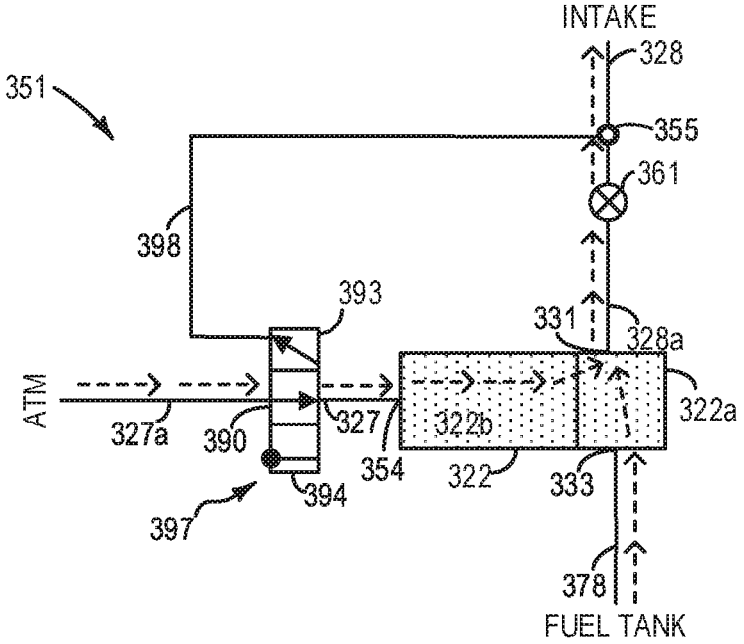
FIG. 3A schematically shows an evaporative emissions system configured to purge stored fuel vapors from a fuel vapor storage canister.

A typical purge operation is illustrated in FIG. 3A. In FIG. 3A, the three-way valve 397 is shown in a first position 390, the canister purge valve 361 may be understood to be open, and the intake manifold may comprise a vacuum sufficient to execute a purging operation. As engine intake vacuum is applied to evaporative emissions system 351, fresh air enters vent line segment 327*a*, passing through three-way valve 397 configured in first position 390 and vent line 327 into fuel vapor canister 322 via canister vent port 354. Fresh air entering canister 322 will promote desorption of adsorbed fuel vapor within canister adsorbent bed 322*b* and within canister buffer 322*a*. The purge gasses, including desorbed fuel vapor and vapors from the fuel tank, will enter purge line segment 328*a*, passing through canister purge valve 361 and purge line segment 328 en route to engine intake. As such, by opening canister purge valve 361 and configuring three-way valve in first position 390 when the engine is operating under a predetermined set of conditions, fuel tank vapors and desorbed fuel vapors may be purged to engine intake via the flow path indicated by the dashed arrows.

Figure 3B:
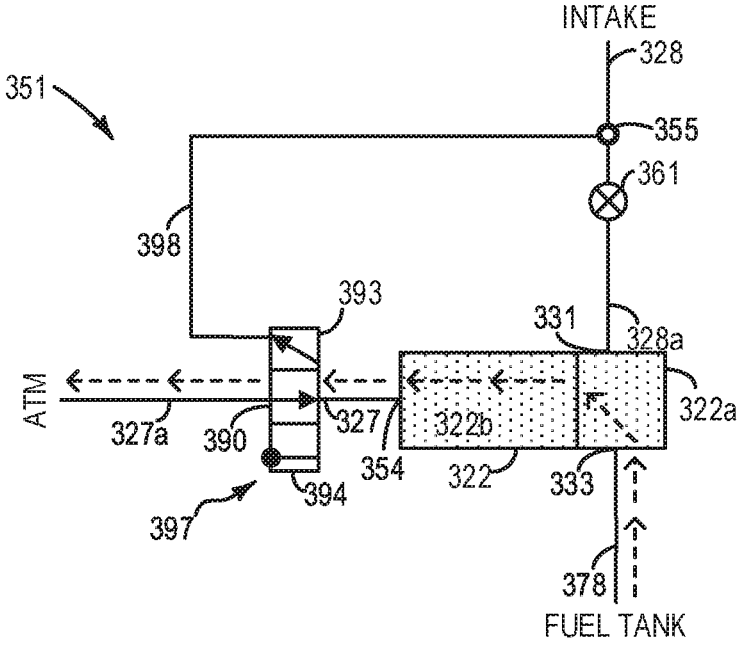
FIG. 3B schematically shows an evaporative emissions system configured to direct fuel tank vapors through a fuel vapor storage canister prior to exiting to atmosphere.

A typical fuel vapor storage mode under conditions wherein the engine is in operation is illustrated in FIG. 3B. In FIG. 3B, the three-way valve 397 is shown in first position 390, and the canister purge valve 361 may be understood to be closed. As such, FIG. 3B represents an engine-on condition where purge conditions are not met. For example, canister load may be below a threshold load, and/or engine intake manifold vacuum may not be sufficient to execute a purging operation. Furthermore, by configuring three-way vent valve in first position 390, vent line 327 is prevented from coupling to vapor line 398 and engine intake. As such, by closing canister purge valve 361 and configuring three-way valve in first position 390 when the engine is operating under a predetermined set of conditions, fuel tank vapors may be routed to the fuel vapor canister 322 for adsorption prior to exiting to atmosphere, via the flow path indicated by the dashed arrows.

Figure 3C:
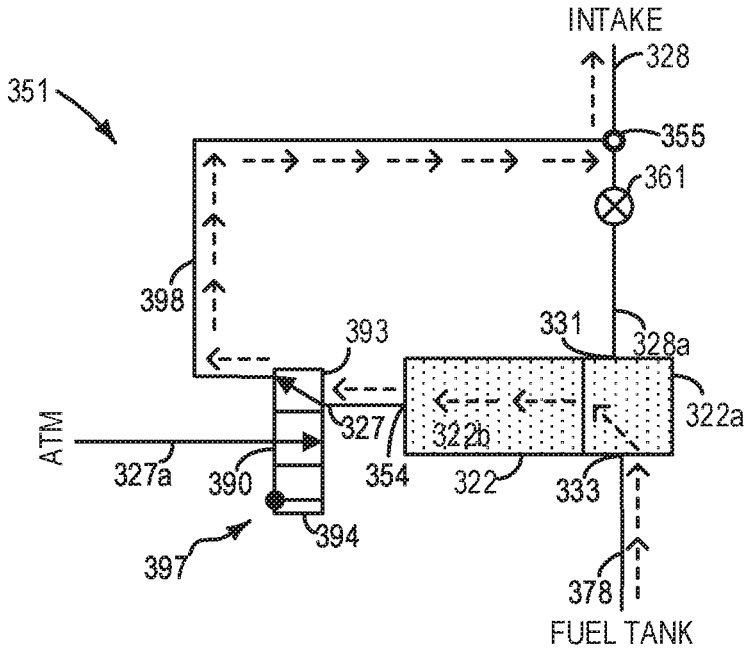
FIG. 3C schematically shows an evaporative emissions system configured to direct fuel tank vapors through a fuel vapor storage canister to an intake manifold of an engine.
Figure 3D:
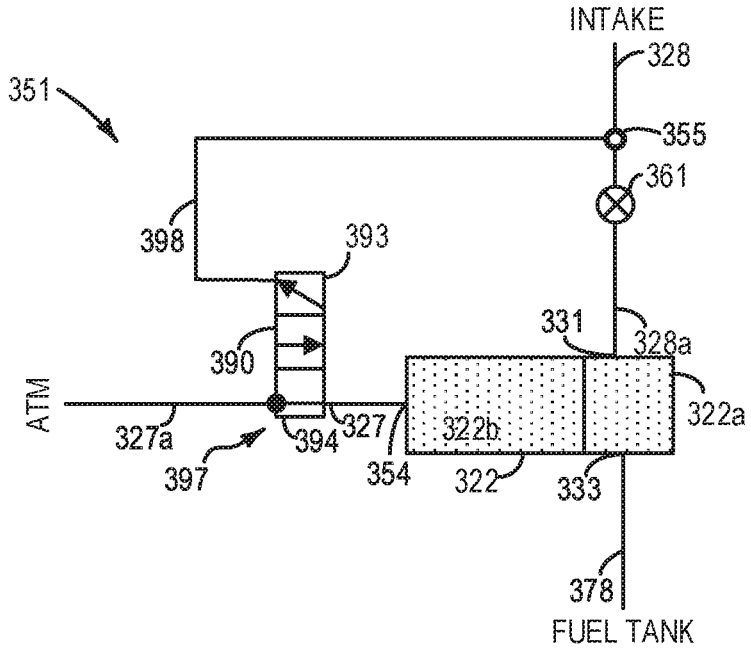
FIG. 3D schematically shows an evaporative emissions system sealed from atmosphere for conducting a diagnostic test for undesired evaporative emissions.

A typical fuel vapor storage mode under conditions wherein the engine is not in operation is illustrated in FIG. 3C. In FIG. 3C, the three-way valve 397 is positioned in second position 393, and the canister purge valve 361 may be understood to be closed. As such, FIG. 3C represents an engine-off condition, and may in one example include a refueling event. In still other examples, FIG. 3C may represent an engine-off event where the vehicle is being powered solely by battery power, or an engine-off event where the vehicle is parked for a duration. In the example case where the engine-off event includes a refueling event, it may be understood that an air intake throttle (not shown) may additionally be configured in an open position to facilitate air flow during the refueling operation. By configuring three-way vent valve 397 in second position 393, while maintaining closed canister purge valve 361, fuel tank vapors may be routed through the fuel vapor canister 322 to vent line segment 327, through three-way vent valve 397 and vapor line 398 to engine intake via purge line segment 328, as indicated by the dashed arrows. As described above and which will be described in further detail below, routing fuel tank vapors through the fuel vapor canister 322 to engine intake during engine-off conditions may reduce bleed emissions, as fuel tank vapors not adsorbed by the fuel vapor canister may be captured and stored in the engine intake manifold via a second vapor adsorbent (e.g., 224), the second vapor adsorbent smaller than the adsorbent housed within fuel vapor canister 322. Furthermore, any fuel tank vapors that are not adsorbed by fuel vapor canister 322, and which may pass by the second vapor adsorbent (e.g., 224), may be converted to less harmful gasses by the one or more emission control devices (e.g., 270), while the emission control device light-off temperature is maintained for a duration after an engine-off event.

A typical evaporative emissions diagnostic test mode is illustrated in FIG. 3D. In FIG. 3D, three-way vent valve 397 is configured in third position 394. As such, vent line segment 327 is sealed from vent line segment 327*a*. Furthermore, it may be understood that canister purge valve 361 is configured in a closed position, thus sealing purge line segment 328*a* from purge line segment 328. With three-way vent valve 397 configured in third position 394 and with canister purge valve 361 commanded closed, the fuel vapor canister 322 and the fuel tank may be sealed from atmosphere and the presence or absence of undesired evaporative emissions assessed. As described above, and which will be described in further detail below, in one example, an evaporative emissions test diagnostic may include an engine-off test using engine off natural vacuum (EONV) generated due to a change in temperature and pressure at the fuel tank following engine shutdown. By monitoring pressure and/or vacuum in the evaporative emissions system 351 and fuel tank when sealed from atmosphere and from engine intake, the presence or absence of undesired evaporative emissions may be assessed. In another example, an engine-off evaporative emissions test diagnostic may include pressurizing and or evacuating evaporative emissions system 351 via an onboard pump (not shown), and monitoring pressure and/or vacuum to indicate the presence or absence of undesired evaporative emissions. Alternatively, examples of engine-on evaporative emissions detection routines may include evacuating evaporative emissions system 351 via engine intake manifold vacuum by opening canister purge valve 361, then closing canister purge valve 361 subsequent to a threshold vacuum being reached. Pressure bleed-up in the evaporative emissions system 351 may then be monitored and compared to a threshold bleed-up rate. Based on the comparison, the integrity of the evaporative emissions system may be diagnosed. In another example of an engine-on evaporative emissions test, pressure or vacuum may be applied to evaporative emissions system 351 via an onboard pump prior to sealing evaporative emissions system 351 from atmosphere and from engine intake, and the presence or absence of undesired evaporative emissions indicated by monitoring pressure in evaporative emission system 351 and fuel tank, as described above.

Turning to FIG. 4, a flow chart for an example method 400 for controlling a vehicle evaporative emissions system to manage fuel tank vapors is shown. More specifically, method 400 may be used to, responsive to an engine-off condition, route fuel tank vapors from the fuel tank through a fuel vapor canister to be adsorbed, and then to engine intake where any fuel tank vapors that were not adsorbed by the fuel vapor canister may be adsorbed by a second adsorbent positioned in the engine intake manifold. Alternatively, responsive to an engine-on condition, fuel tank vapors may be routed to the fuel vapor canister to be adsorbed prior to exiting to atmosphere, without being routed to the engine intake manifold. Furthermore, during engine operation, fuel tank vapors and stored fuel vapors may be intermittently purged to engine intake for combustion. As such, potential bleed-emissions may be reduced during engine-off conditions without the use of bleed canisters, which are costly and which are restrictive to refueling air flow. Method 400 will be described with reference to the systems described herein and shown in FIGS. 1-3D, though it should be understood that similar methods may be applied to other systems without departing from the scope of this disclosure. Method 400 may be carried out by a controller, such as controller 212 in FIG. 2, and may be stored at the controller as executable instructions in non-transitory memory. Instructions for carrying out method 400 and the rest of the methods included herein may be executed by a controller based on instructions stored on a memory of the controller and in conjunction with signals received from sensors of the engine system, such as the sensors described above with reference to FIGS. 1 and 2. The controller may employ actuators of the evaporative emissions system to manage fuel tank vapors, such as three-way valve (e.g., 297) and canister purge valve (e.g., 261), according to the methods described below. In the method described below, it may be understood that a fuel tank isolation valve (e.g., 252) is not included in the vehicle system, and it may furthermore be understood that the method does not include an ELCM pump (e.g., 295). As such, avoiding the use of a fuel tank isolation valve and an ELCM pump may reduce costs and weight in the vehicle. However, it should be understood that a fuel tank isolation valve (e.g., 252), and/or an ELCM pump may be included in the vehicle system without departing from the scope of the present disclosure.

Method 400 begins at 403 and includes evaluating current operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing to 406, method 400 includes determining whether an engine-off event has occurred. The engine-off event may be indicated by other events, such as a key-off event. In some examples, an engine-off event may comprise a condition where the vehicle is operating solely by battery power. In some examples, the engine-off event may follow a vehicle run time duration, the vehicle run time duration commencing at a previous vehicle-on event. If an engine-off event is detected, method 400 may proceed to 409.

At 409, method 400 may include indicating whether a refueling event is requested. For example, a refueling request may comprise a vehicle operator depression of a refueling button on a vehicle instrument panel in the vehicle (e.g., refueling button 197), or at a refueling door. In some examples, a refueling request may comprise a refueling operator requesting access to a fuel filler neck, for example, by attempting to open a refueling door, and/or attempting to remove a gas cap. If a refueling event has been requested, method 400 may proceed to 412. At 412, method 400 may include configuring a three-way vent valve (e.g., 297) in a second position (e.g., 293). As described above, configuring the three-way vent valve in the second position may couple a vent port (e.g., 254) of a fuel vapor canister to an intake manifold of a vehicle engine. Furthermore, at 412, method 400 may include commanding closed or maintaining closed a canister purge valve (e.g., 261) such that vapors from a fuel tank are routed through the fuel vapor canister vapor adsorbent for adsorption and then to the intake manifold of the engine without being routed through the canister purge valve.

Proceeding to 415, method 400 may include commanding open an air intake throttle (e.g., 262). By commanding open the air intake throttle such that the intake manifold is coupled to atmosphere, air flow from the fuel tank, through the fuel vapor canister, and to the engine intake manifold may be facilitated during the refueling event. Furthermore, by commanding open the air intake throttle during the refueling event, premature shutoffs at the refueling dispensing pump may be avoided. In other words, by commanding open the throttle, pressure builds in the fuel tank during refueling that may cause liquid fuel to back up in a fill tube and thereby actuate an automatic shut-off of the refueling dispenser, thus terminating the flow of fuel into the tank, may be avoided.

Continuing at 418, method 400 may include indicating whether the refueling event is complete. For example, completion of refueling at 418 may be indicated when the fuel level has plateaued for a predetermined duration of time. Indicating whether the refueling event is complete may further include an indication that a refueling nozzle has been removed from the fuel filler neck, replacement of a fuel cap, closing of a refueling door, etc. If the refueling event is not indicated to be complete at 418, method 400 may include maintaining the three-way vent valve in the second position, with the throttle open until it is indicated that the refueling event is complete. Alternatively, if at 418 it is indicated that the refueling event is complete, method 400 may proceed to 421.

At 421, method 400 may include closing the air intake throttle, or returning the air intake throttle to a default engine-off position. However, in other examples the throttle may be continued to be commanded open subsequent to completion of a refueling event. Continuing to 424, method 400 may include maintaining the three-way vent valve in the second position. By maintaining the three-way vent valve in the second position, any fuel tank vapors not adsorbed by the fuel vapor canister during refueling may be routed to the intake manifold, where they may be adsorbed by a second vapor adsorbent (e.g., 224) positioned in the intake manifold. Furthermore, as a refueling event was recently completed, the canister may be saturated with fuel vapors. In some examples, such as a vehicle operating solely in battery mode, subsequent to refueling, it may be some time before the engine is activated and a fuel vapor canister purge event can be initiated. In such an example, by maintaining the three-way valve in the second position such that the canister vent port is coupled to the engine intake manifold, fuel vapors that are freed from the canister while the engine is off may be captured by the second vapor adsorbent in the intake manifold, and may thus reduce bleed emissions.

Proceeding to 427, method 400 may include updating canister loading state, and updating the canister purge schedule. For example, the canister loading state may be updated to reflect the recent refueling event, and similarly, the canister purge schedule may be updated to reflect the loading state of the canister responsive to the refueling event. In some examples, canister loading state may be indicated based on temperature change within the canister as monitored by one or more temperature sensors coupled to and/or within the canister (e.g., 232). As described above, as fuel vapor is adsorbed by the adsorbent, heat is generated. As such, by monitoring canister temperature during the refueling event, canister load may be estimated. Method 400 may then end.

Returning to 409, if an engine-off event is indicated, yet a refueling event is not requested, method 400 may proceed to 430. At 430, method 400 may include indicating whether entry conditions are met for an engine off natural vacuum (EONV) diagnostic procedure. Entry conditions may include one or more of the engine at rest with all cylinders off, a threshold amount of time passed since the previous EONV test, a threshold length of engine run time prior to the engine-off event, an amount of fuel in the fuel tank within a predetermined range, ambient temperature above a threshold, air mass summation above a threshold, a threshold battery state of charge, a key-off condition, etc. If entry conditions for an EONV test are met, method 400 may proceed to FIG. 5, and may include conducting an EONV test diagnostic. Alternatively, if test conditions for an EONV test are not met, method 400 may proceed to 433, and may include configuring three-way vent valve in the second position. For example, as the engine is off, a refueling event is not requested, and conditions are not met for an EONV test diagnostic, configuring the three-way valve in the second position may route fuel tank vapors from the fuel tank through the fuel vapor canister to the intake manifold during the engine off condition. As such, any fuel tank vapors not adsorbed by the fuel vapor canister, or fuel vapors that are freed from the fuel vapor canister during the engine off condition, may be routed to the intake manifold where they may be adsorbed by the second adsorbent positioned in the engine intake manifold. Furthermore, while the engine is off and wherein a refueling event is not requested and conditions are not met for an EONV test diagnostic, configuring the three-way valve in the second position may further include commanding the throttle closed. With the throttle closed, any vapors that break through the first adsorbent canister and the second adsorbent may be routed through an arduous path including engine cylinders, intake and exhaust valves, the catalyst, muffler, and exhaust pipe before escaping to atmosphere. By configuring the three-way vent valve in the second position while the engine is not in operation, under conditions where the vehicle is operating solely by battery power, or under conditions where the vehicle is in a key-off condition for a duration, potential bleed emissions from the fuel vapor canister may be reduced.

Returning to 406, if an engine-off event is not indicated, method 400 may proceed to 436. At 436, method 400 may include indicating whether canister purge conditions are met. Purge conditions may include an engine-on condition, canister load above a threshold, an intake manifold vacuum above a threshold, an estimate or measurement of temperature of an emission control device such as a catalyst being above a predetermined temperature associated with catalytic operation commonly referred to as light-off temperature, a non-steady state engine condition, and other operating conditions that would not be adversely affected by a canister purge operation. If, at 436, canister purge conditions are indicated to be met, method 400 may proceed to 439. At 439, method 400 may include configuring three-way vent valve in a first position. As described above, With the three-way valve configured in the first position, a vent port (e.g., 254) may be coupled to atmosphere via a vent line (e.g., 227). Proceeding to 442, method 400 may include commanding open the canister purge valve (e.g., 261). By commanding open the canister purge valve with the three-way vent valve configured in the first position, at 445 fresh air may enter the canister via the vent port, thus promoting the desorption of adsorbed fuel vapor within the canister adsorbent bed. The purge gasses, including desorbed fuel vapor and vapors from the fuel tank, will pass through the purge valve and be directed to the intake manifold and be combusted in the engine.

The purging in this fashion may be continued until the stored fuel vapor amount in the canister is below a predetermined threshold canister load. During purging, a learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more exhaust gas oxygen sensors (e.g., 237) may be positioned in the engine exhaust to provide an estimate of a canister load (that is, an amount of fuel vapors stored in the canister). Exhaust gas sensor may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Based on the canister load, and further based on engine operating conditions, such as engine speed-load conditions, a purge flow rate may be determined. In one example, purging the canister may include indicating an air/fuel ratio via, for example, a proportional plus integral feedback controller coupled to a two-state exhaust gas oxygen sensor, and responsive to the air/fuel indication and a measurement of inducted air flow, generating a base fuel command. To compensate for purge vapors, a reference air/fuel ratio, related to engine operation without purging, may be subtracted from the air/fuel ratio indication and the resulting error signal (compensation factor) generated. As such, the compensation factor may represent a learned value directly related to fuel vapor concentration, and may be subtracted from the base fuel command to correct for the induction of fuel vapors.

In other examples (not shown), one or more oxygen sensors may be positioned in the engine intake, or coupled to the canister (e.g., downstream of the canister), to provide an estimate of canister load. In still further examples, one or more temperature sensors may be coupled to and/or within the fuel vapor canister. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister, and may be used to estimate canister load.

Responsive to an indication that canister load is below a predetermined threshold, or responsive to an indication that canister purge conditions are no longer met, method 400 may proceed to 448. For example, a condition where purge conditions are no longer met may include an intake manifold vacuum rising above a threshold vacuum level. As such, at 448, method 400 may include commanding closed the canister purge valve to seal the fuel vapor canister from engine intake. Furthermore, the three-way vent valve may be maintained in the first position, thus maintaining the fuel vapor canister vent port coupled to atmosphere. As such, while the engine is operating, running loss fuel vapors from the fuel tank may be directed to the fuel vapor canister where they may be adsorbed, prior to exiting to atmosphere via the three-way valve configured in the first position. As such, undesired evaporative emissions may be reduced during engine-on conditions, without routing the fuel tank vapors to the engine intake manifold in the absence of a canister purging operation.

Proceeding to 451, method 400 may include may include updating canister loading state, and updating the canister purge schedule. For example, the canister loading state may be updated to reflect the recent purge event. Updating the canister purge schedule at 451 may include scheduling further canister purge events responsive to the canister loading state indicated after the recent purge event. Method 400 may then end.

Returning to 436, if canister purge conditions are not met, method 400 may proceed to 454. At 454, method 400 may include indicating whether entry conditions are met for an engine-on evaporative emissions test diagnostic. In some examples, entry conditions for an engine-on evaporative emissions test may include an engine intake manifold vacuum above a threshold, a fuel level within a predetermined range, ambient temperature within a predetermined range, vehicle speed within a predetermined range, a threshold time since a previous engine-on evaporative emissions test, an indication that a canister purge operation is not being conducted, etc. If, at 454 it is indicated that entry conditions for an engine-on evaporative emissions test are met, method 400 may proceed to FIG. 6, and may include conducting an engine-on evaporative emissions test according to the method depicted therein. Alternatively, if at 454 it is indicated that entry conditions are not met for an engine-on evaporative emissions test, method 400 may proceed to 457. At 457, method 400 may include configuring the three-way vent valve in the first position. As described above, when the three-way vent valve is configured in the first position, the fuel vapor canister vent port may be coupled to atmosphere. As such, while the engine is operating, running loss fuel vapors from the fuel tank may be directed to the fuel vapor canister where they may be adsorbed, prior to exiting to atmosphere. Method 400 may then end.

Turning now to FIG. 5, a flow chart for a high level example method 500 for performing an engine-off natural vacuum (EONV) test on an evaporative emissions system and fuel system, is shown. More specifically, method 500 continues from method 400 depicted in FIG. 4 and may be used in an evaporative emissions system with a three-way valve (e.g., 297) positioned between a fuel vapor canister vent port and atmosphere, where the three-way valve may be configured in a third position in order to seal the evaporative emissions system and fuel system from atmosphere for conducting an EONV test. Method 500 will be described with reference to the systems described herein and shown in FIGS. 1-2 and FIG. 3D, though it should be understood that similar methods may be applied to other systems without departing from the scope of this disclosure. Method 500 may be carried out by a controller, such as controller 212 in FIG. 2, and may be stored at the controller as executable instructions in non-transitory memory. Instructions for carrying out method 500 and the rest of the methods included herein may be executed by the controller based on instructions stored on a memory of the controller and in conjunction with signals received from sensors of the engine system, such as the sensors described above with reference to FIG. 1 and FIG. 2. The controller may employ fuel system and evaporative emissions system actuators, such as three-way valve (e.g., 297), and canister purge valve (e.g., 261), according to the method below. In the method described below, it may be understood that a fuel tank isolation valve (e.g., 252) is not included in the vehicle system, and it may furthermore be understood that the method does not include an ELCM pump (e.g., 295). As such, avoiding the use of a fuel tank isolation valve and an ELCM pump may reduce costs and weight in the vehicle. However, it should be understood that a fuel tank isolation valve (e.g., 252), and/or an ELCM pump may be included in the vehicle system without departing from the scope of the present disclosure.

Method 500 begins at 503 and may include configuring the three-way vent valve in the third position. As described above with regard to FIG. 3D, when the three-way vent valve is configured in the third position, a vent port (e.g., 254) may be sealed from atmosphere. Proceeding to 506, method 500 may include commanding closed or maintaining closed the canister purge valve. With the canister purge valve in a closed conformation, and the three-way valve configured in a third position, the fuel vapor canister and the fuel tank may be sealed from both atmosphere and from the engine intake manifold. As described above, with the fuel vapor canister and fuel tank sealed from atmosphere and from engine intake, an EONV test diagnostic may be conducted via changes in temperature and pressure in the fuel system and evaporative emissions system following engine shutdown. By monitoring pressure and/or vacuum in the evaporative emissions system and fuel system when sealed from atmosphere and from engine intake, the presence or absence of undesired evaporative emissions may be assessed.

As such, proceeding to 508, method 500 may include performing a pressure rise test. For example, while the engine is still cooling down post shut-down, there may be additional heat rejected to the fuel tank. With the fuel system sealed via configuring the three-way vent valve in the third position and maintaining closed the canister purge valve, pressure in the fuel tank may rise due to fuel volatizing with increased temperature. The pressure rise test may include monitoring fuel tank pressure for a period of time. Fuel tank pressure may be monitored until the pressure reaches a predetermined threshold, the predetermined threshold pressure indicative of no undesired evaporative emissions above a threshold size in the fuel tank. In some examples, the rate of pressure change may be compared to an expected rate of pressure change. The fuel tank pressure may not reach the threshold pressure. Rather, the fuel tank pressure may be monitored for a predetermined amount of time, or an amount of time based on the current conditions. The fuel tank pressure may be monitored until consecutive measurements are within a threshold amount of each other, or until a pressure measurement is less than the previous pressure measurement. In still other examples, the fuel tank pressure may be monitored until the fuel tank temperature stabilizes. Method 500 may then proceeds to 509.

Continuing at 509, method 500 includes determining whether the pressure rise test ended due to a passing result, such as the fuel tank pressure reaching the predetermined threshold. If the pressure rise test indicated a passing result, method 500 may proceed to 512. At 512, method 500 may include indicating the passing test result. Indicating the passing result may include recording the successful outcome of the EONV test diagnostic at the controller. Continuing to 515, method 500 may include configuring the three-way vent valve in the second position. As described above, by configuring the three-way vent valve in the second position, the canister vent port (e.g., 254) may be coupled to the engine intake manifold. As such, during engine-off conditions, fuel vapors that are freed from the canister may be routed to the intake manifold, where they may be captured and stored by the second vapor adsorbent (e.g., 224), and may thus reduce bleed emissions. Furthermore, by configuring the three-way valve in the second position, pressure in the fuel system and evaporative emissions system may be returned to atmospheric pressure.

Proceeding to 518, method 500 may include updating the evaporative emissions test schedule. For example, scheduled tests may be delayed or adjusted based on the passing result. Method 500 may then end.

Returning to 509, if pressure in the fuel system and evaporative emissions system did not reach the predetermined threshold, method 500 may proceed to 521. At 521, method 500 may include commanding the three-way vent valve to the second position, thus coupling the canister vent port to atmosphere. As such, pressure in the fuel system and evaporative emissions system may be returned to atmospheric pressure. The system may be allowed to stabilize until pressure in the fuel system and evaporative emissions system reaches atmospheric pressure, and/or until consecutive pressure readings are within a threshold of each other. Method 500 may then proceed to 524.

At 524, method 500 may include configuring the three-way vent valve in the third position. As described above, configuring the three-way valve in the third position seals the canister vent port from atmosphere, and from the engine intake manifold. As the canister purge valve is maintained closed, configuring the three-way valve in the third position thus re-seals the fuel system and evaporative emissions system from atmosphere and from the engine intake manifold. As the fuel tank cools, the fuel vapors may condense into liquid fuel, thus creating a vacuum within the tank. Proceeding to 527, method 500 includes performing a vacuum test. Performing a vacuum test at 527 may include monitoring pressure in the fuel system and evaporative emissions system for a duration. Pressure may be monitored until the vacuum reaches a predetermined threshold, the predetermined threshold indicative of no undesired evaporative emissions above a threshold size in the fuel system or evaporative emissions system. In some examples, the rate of pressure change may be compared to an expected rate of pressure change. Pressure in the fuel system and evaporative emissions system may in some examples not reach the predetermined threshold vacuum. Rather, pressure in the fuel system and evaporative emissions system may be monitored for a predetermined duration, or a duration based on the current conditions. In some examples, the duration for monitoring pressure in the fuel system and evaporative emissions system during the vacuum test may be based on a level of charge of a battery in the vehicle system. In other words, the time limit for the vacuum-based portion of the EONV test may be based on the battery state of charge.

Continuing at 530, method 500 may include determining whether the vacuum build in the fuel system and evaporative emissions system reached the predetermined vacuum threshold level. If, at 530, it is indicated that the predetermined vacuum threshold was reached, method 500 may proceed to 512, and may include indicating a passing result. For example, indicating the passing result may include recording the successful outcome of the EONV test at the controller. Continuing to 515, method 500 may include configuring the three-way vent valve in the second position. As described above, by configuring the three-way vent valve in the second position, the canister vent port (e.g., 254) may be coupled to the engine intake manifold. As such, during engine-off conditions, fuel vapors that are freed from the canister may be routed to the intake manifold, where they may be captured and stored by the second vapor adsorbent (e.g., 224), and may thus reduce bleed emissions. Furthermore, by configuring the three-way valve in the second position, pressure in the fuel system and evaporative emissions system may be returned to atmospheric pressure.

Proceeding to 518, method 500 may include updating the evaporative emissions test schedule. For example, scheduled tests may be delayed or adjusted based on the passing result. Method 500 may then end.

Returning to 530, if the vacuum build in the fuel system and evaporative emissions system did not reach the predetermined vacuum threshold level, method 500 may proceed to 533. At 533, method 500 may include recording the negative test result. Indicating the negative result may include recording the unsuccessful outcome of the EONV test at the controller. Continuing to 536, method 500 may include configuring the three-way vent valve in the second position. As described above, by configuring the three-way vent valve in the second position, the canister vent port (e.g., 254) may be coupled to the engine intake manifold. As such, during engine-off conditions, fuel vapors that are freed from the canister may be routed to the intake manifold, where they may be captured and stored by the second vapor adsorbent (e.g., 224), and may thus reduce bleed emissions. Furthermore, by configuring the three-way valve in the second position, pressure in the fuel system and evaporative emissions system may be returned to atmospheric pressure.

Proceeding to 539, method 500 may include updating the evaporative emissions test schedule. For example, scheduled tests may be delayed or adjusted based on the unsuccessful result. Method 500 may then end.

Figure 6:
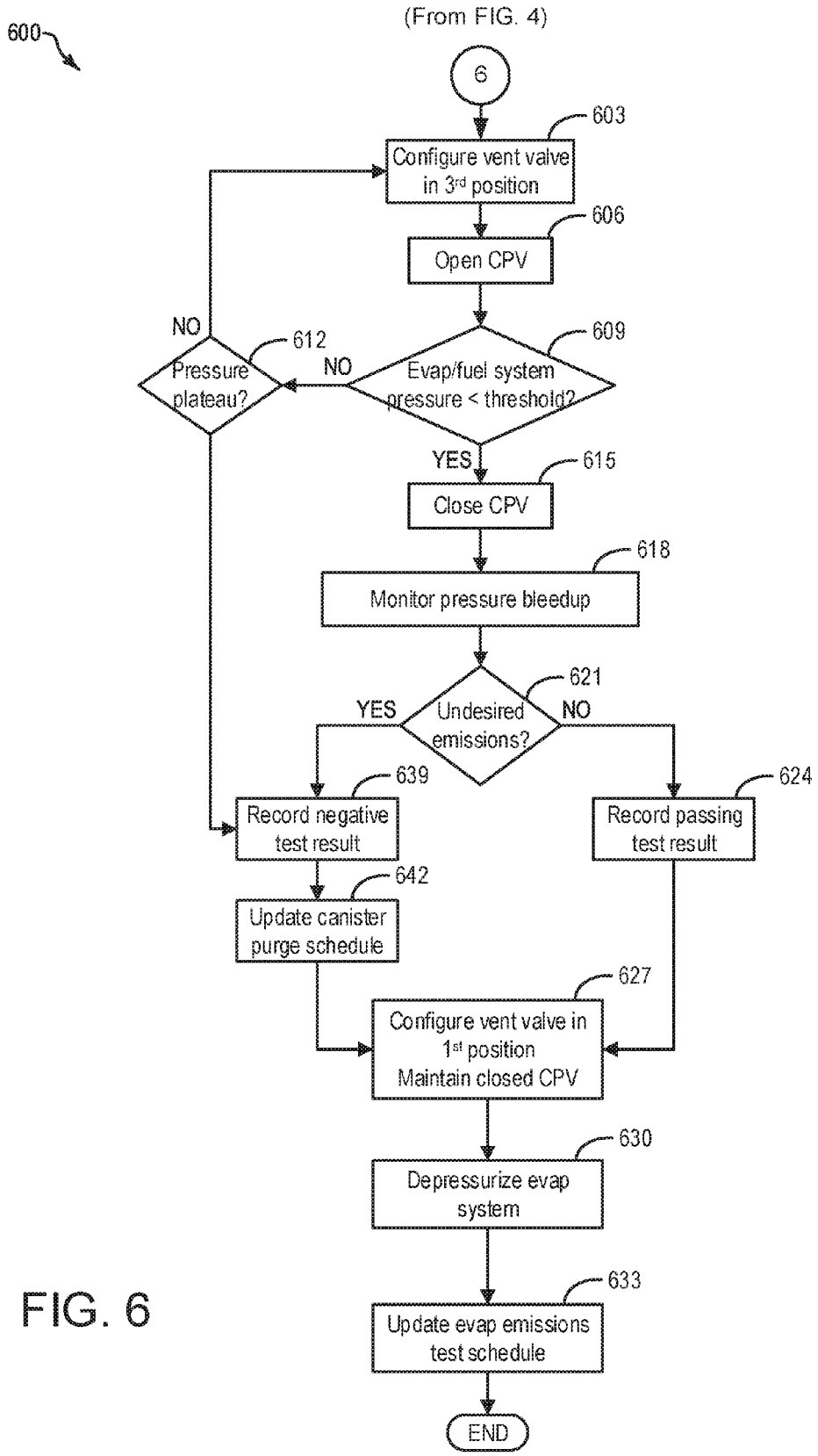
FIG. 6 shows a flowchart for a high level example method continuing from FIG. 4 for conducting an engine-on test for undesired evaporative emissions.
Figure 7:
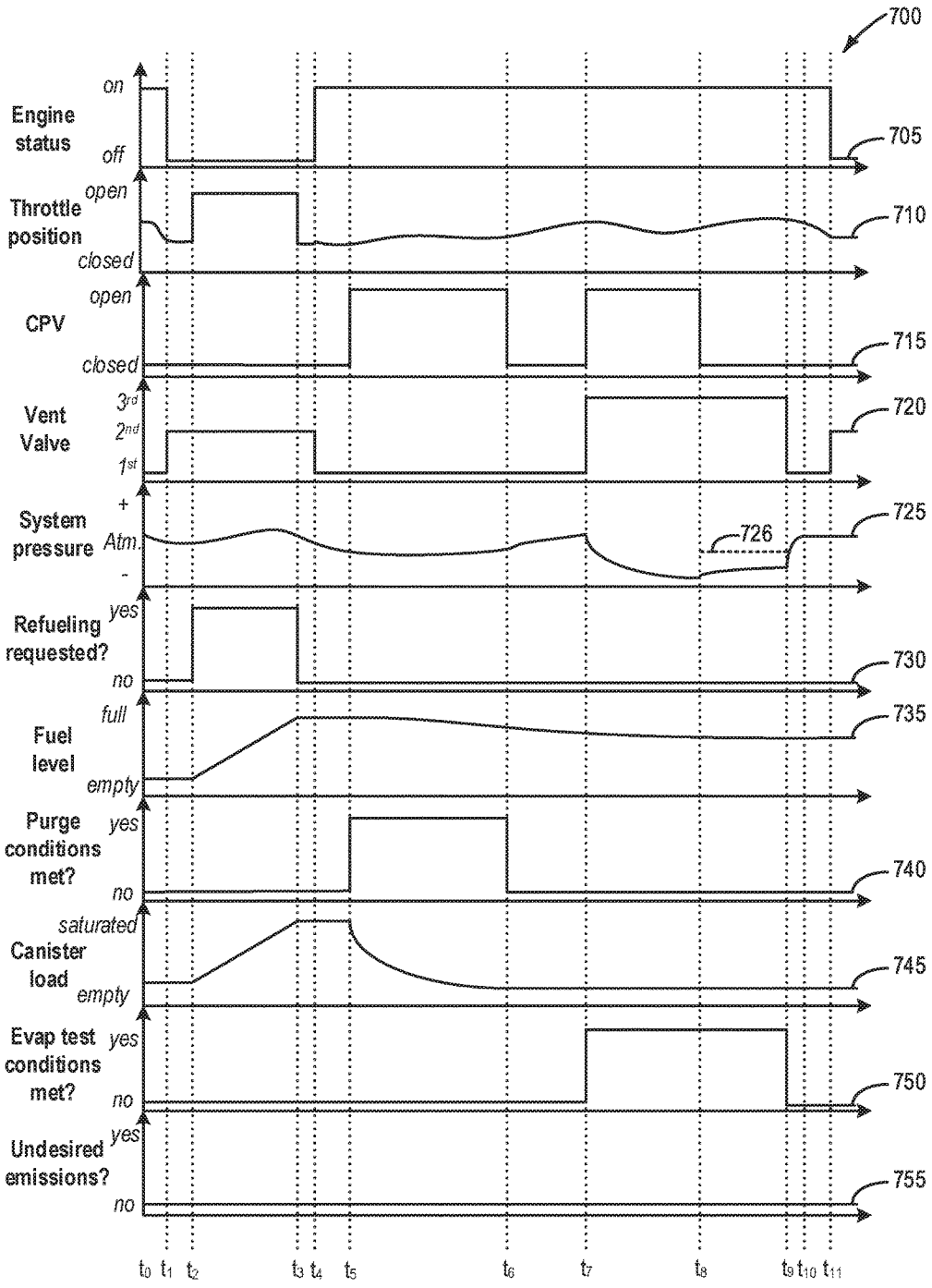
FIG. 7 shows an example timeline for controlling an evaporative emissions system to reduce undesired evaporative emissions, according to the methods depicted in FIGS. 4-6.

Turning now to FIG. 6, an example timeline 600 for an engine-on evaporative emissions test on an evaporative emissions system and fuel system, is shown. More specifically, method 600 may continue from method 400 depicted in FIG. 4, and may be used in an evaporative emissions system with a three-way valve (e.g., 297) positioned between a fuel vapor canister vent port and atmosphere, where the three-way valve may be configured in a third position in order to seal the evaporative emissions system and fuel system from atmosphere for conducting an engine-on evaporative emissions test. Method 600 will be described with reference to the systems described herein and shown in FIGS. 1-2 and FIG. 3D, though it should be understood that similar methods may be applied to other systems without departing from the scope of this disclosure. Method 600 may be carried out by a controller, such as controller 212 in FIG. 2, and may be stored at the controller as executable instructions in non-transitory memory. Instructions for carrying out method 600 and the rest of the methods included herein may be executed by the controller based on instructions stored on a memory of the controller and in conjunction with signals received from sensors of the engine system, such as the sensors described above with reference to FIG. 1 and FIG. 2. The controller may employ fuel system and evaporative emissions system actuators, such as three-way valve (e.g., 297), and canister purge valve (e.g., 261), according to the method below. In the method described below, it may be understood that a fuel tank isolation valve (e.g., 252) is not included in the vehicle system, and it may furthermore be understood that the method does not include an ELCM pump (e.g., 295). As such, avoiding the use of a fuel tank isolation valve and an ELCM pump may reduce costs and weight in the vehicle. However, it should be understood that a fuel tank isolation valve (e.g., 252), and/or an ELCM pump may be included in the vehicle system without departing from the scope of the present disclosure.

Method 600 begins at 603 and may include configuring the three-way vent valve in the third position. As described above with regard to FIG. 3D, when the three-way vent valve is configured in the third position, a vent port (e.g., 254) may be sealed from atmosphere. Proceeding to 606, method 600 may include commanding open the canister purge valve to couple the evaporative emissions system and fuel system to the engine intake manifold. As such, vacuum in the intake manifold may be communicated to the evaporative emissions system and fuel system.

Proceeding to 609, method 600 may include indicating whether pressure in the evaporative emissions system and fuel system is below a predetermined negative pressure threshold. The predetermined negative pressure threshold may comprise a negative pressure with respect to atmospheric pressure, the predetermined negative pressure threshold based on a difference from atmospheric pressure sufficient to monitor a subsequent pressure increase rate, described in further detail below.

For example, vacuum from the engine intake manifold may be applied to the evaporative emissions system and fuel system until the predetermined threshold negative pressure level has been reached. If, at 609, the predetermined threshold negative pressure level has not been reached, method 600 may proceed to 612. At 612, method 600 may include indicating whether pressure in the evaporative emissions system and fuel system has reached a plateau without reaching the predetermined threshold negative pressure level. If, at 612, a pressure plateau is not indicated, method 600 may continue to couple the evaporative emissions system and fuel system to the engine intake manifold to continue applying vacuum on the fuel system and evaporative emissions system. Alternatively, responsive to an indication that pressure in the fuel system and evaporative emissions system reached a plateau prior to reaching the predetermined negative pressure threshold, method 600 may proceed to 639 and may include recording a negative test result. For example, as engine intake manifold vacuum was applied to the fuel system and evaporative emissions system, yet pressure in the fuel system and evaporative emissions system did not reach the predetermined negative pressure threshold, undesired evaporative emissions may be indicated. In other words, although the method did not proceed to conducting the evaporative emissions test according to method 600 continuing at step 609, because it was not possible to reach the predetermined negative pressure threshold with applied engine intake manifold vacuum, undesired evaporative emissions may be indicated. Proceeding to 642, method 600 may include taking an action responsive to the indication of undesired evaporative emissions, where the source of undesired evaporative emissions is such that engine intake manifold vacuum was unable to lower vacuum in the fuel system and/or evaporative emissions system to the predetermined negative pressure threshold. For example, taking an action may include updating a canister purge schedule, where updating the canister purge schedule may include performing purge operations more frequently such that fuel vapor in the fuel system and/or evaporative emissions system may be effectively routed to the engine for combustion, rather than escaping to the atmosphere. Continuing to 627, method 600 may include commanding closed the canister purge valve, and commanding the three-way valve in the first position. As described above, with the three-way valve configured in the first position, the canister vent port may be coupled to atmosphere. As such, the fuel system and evaporative emissions system may be sealed from engine intake, and at 630, pressure in the fuel system and evaporative emissions system may be returned to atmospheric pressure. Furthermore, as described above, with the three-way valve configured in the first position, while the engine is operating, running loss fuel vapors from the fuel tank may be directed to the fuel vapor canister where they may be adsorbed, prior to exiting to atmosphere.

Proceeding to 633, method 600 may include updating an evaporative emissions test schedule responsive to the indication of the presence of undesired evaporative emissions. In one example, updating the evaporative emissions test schedule at 633 may include suspending scheduled evaporative emissions tests until it is indicated that the source of undesired evaporative emissions has been mitigated. Method 600 may then end.

Returning to 609, if pressure in the fuel system and evaporative emissions system is indicated to reach the predetermined negative pressure threshold, method 600 may proceed to 615. At 615, method 600 may include sealing the fuel system and evaporative emissions system from engine intake by commanding closed the canister purge valve. Proceeding to 618, method 600 may include conducting the evaporative emissions test diagnostic. For example, pressure in the fuel system and evaporative emissions system may be monitored, and based on a pressure increase rate (e.g., bleed-up rate), the presence or absence of undesired evaporative emissions may be determined. In one example, a predetermined pressure threshold may be set (e.g., atmospheric pressure), and responsive to pressure in the fuel system and evaporative emissions system not reaching the predetermined pressure threshold in a predetermined duration, an absence of undesired evaporative emissions may be indicated. In other words, undesired evaporative emissions may be indicated responsive to a pressure increase rate in the fuel system and evaporative emissions system greater than a threshold pressure increase rate, subsequent to the predetermined negative pressure threshold being reached and with the fuel system and evaporative emissions system sealed from vacuum in the intake manifold. Furthermore, it may be understood that a pressure increase rate greater than the threshold pressure increase rate indicates undesired evaporative emissions escaping through a source of at least a defined area.

Continuing to 621, method 600 includes indicating whether undesired evaporative emissions are indicated. For example, if, during a predetermined duration of time allotted for the evaporative emissions test, pressure in the fuel system and evaporative emissions system remains below a predetermined pressure threshold, an absence of undesired evaporative emissions may be indicated. Alternatively, if the predetermined pressure threshold is reached during the predetermined duration of time allotted for the evaporative emissions test, the presence of undesired evaporative emissions may be indicated.

If undesired evaporative emissions are indicated at 621, method 600 may proceed to 639. At 639, method 600 may include recording the negative engine-on evaporative emission test result, and may include recording the negative test result at the controller. Proceeding to 642, method 600 may include taking an action responsive to the indication of undesired evaporative emissions. For example, taking an action may include updating a canister purge schedule, where updating the canister purge schedule may include performing purge operations more frequently such that fuel vapor in the fuel system and/or evaporative emissions system may be effectively routed to the engine for combustion, rather than escaping to the atmosphere. Continuing to 627, method 600 may include commanding closed the canister purge valve, and commanding the three-way valve in the first position. As described above, with the three-way valve configured in the first position, the canister vent port may be coupled to atmosphere. As such, the fuel system and evaporative emissions system may be sealed from engine intake, and at 630, pressure in the fuel system and evaporative emissions system may be returned to atmospheric pressure. Furthermore, as described above, with the three-way valve configured in the first position, while the engine is operating, running loss fuel vapors from the fuel tank may be directed to the fuel vapor canister where they may be adsorbed, prior to exiting to atmosphere.

Proceeding to 633, method 600 may include updating an evaporative emissions test schedule responsive to the indication of the presence of undesired evaporative emissions. In one example, updating the evaporative emissions test schedule at 633 may include suspending scheduled evaporative emissions tests until it is indicated that the source of undesired evaporative emissions has been mitigated. Method 600 may then end.

Returning to 621, if undesired evaporative emissions are not indicated, method 600 may proceed to 624 and may include recording the absence of undesired evaporative emissions in the evaporative emissions system and fuel system. For example, at 624, the passing engine-on evaporative emissions test result may be recorded at the controller. Continuing to 627, method 600 may include configuring the three-way vent valve in the first position, such that, at 630 pressure in the evaporative emissions system and fuel system may be returning to atmospheric pressure. Furthermore, as described above, with the three-way valve configured in the first position, while the engine is operating, running loss fuel vapors from the fuel tank may be directed to the fuel vapor canister where they may be adsorbed, prior to exiting to atmosphere.

Proceeding to 633, method 600 may include updating an evaporative emissions test schedule responsive to the indication of the absence of undesired evaporative emissions. In one example, updating the evaporative emissions test schedule at 633 may include delaying future engine-on evaporative emissions test diagnostics responsive to the indication of the absence of undesired evaporative emissions. Method 600 may then end.

FIG. 7 depicts an example timeline 700 for managing fuel vapor in a vehicle evaporative emissions system, wherein a three-way valve (e.g., 297) is positioned between a canister vent port (e.g., 254) and atmosphere, using the methods described herein and with reference to FIGS. 4-5. Timeline 700 includes plot 705, indicating an on or off status of a vehicle engine, over time. Timeline 700 further includes plot 710, indicating the degree to which an air intake throttle (e.g., 262) is open, or closed, over time. Timeline 700 further includes plot 715, indicating an open or closed status of a canister purge valve (e.g., 261), over time. Timeline 700 further includes plot 720, indicating whether the three-way vent valve (e.g., 297) is configured in a first position, a second position, or a third position, over time. As described above, when the three-way vent valve is configured in the first position, the canister vent port is coupled to atmosphere. When the three-way vent valve is configured in the second position, the canister vent valve is coupled to an engine intake manifold. Finally, when the three-way vent valve is configured in the third position, the canister vent port is sealed from both atmosphere and from the engine intake manifold. Timeline 700 further includes plot 725, indicating pressure in the fuel system (e.g., 218) and evaporative emissions system (e.g., 251), over time. Line 726 represents a predetermined threshold pressure level, which, if reached during a predetermined duration during the course of an evaporative emissions test, the presence of undesired evaporative emissions may be indicated. Timeline 700 further includes plot 730, indicating whether a refueling event is requested, over time. Timeline 700 further includes plot 735, indicating a fuel level in a fuel tank, over time. Timeline 700 further includes plot 740, indicating whether conditions are met for a fuel vapor canister purging operation during engine-on conditions. Timeline 700 further includes plot 745, indicating a fuel vapor canister loading state, over time. Timeline 700 further includes plot 750, indicating whether condition are met for an evaporative emissions test diagnostic procedure. Timeline 700 further includes plot 755, indicating the presence or absence of undesired evaporative emissions in the fuel system and evaporative emissions system, over time. In the timeline described below, it may be understood that a fuel tank isolation valve (e.g., 252) is not included in the vehicle system, and it may furthermore be understood that the method does not include an ELCM pump (e.g., 295). As such, avoiding the use of a fuel tank isolation valve and an ELCM pump may reduce costs and weight in the vehicle. However, it should be understood that a fuel tank isolation valve (e.g., 252), and/or an ELCM pump may be included in the vehicle system without departing from the scope of the present disclosure.

At time $t_0$, the engine is in operation, indicated by plot 705. The canister purge valve (CPV), indicated by plot 715, is closed, and the three-way vent valve, indicated by plot 720, is configured in the first position. As such, the fuel system and evaporative emission system may be understood to be sealed from the intake manifold, but coupled to atmosphere, as described above with regard to FIG. 3B. In such a configuration, running loss vapors from the fuel tank during engine operation may be routed to the fuel vapor canister for adsorption, prior to exiting to atmosphere. As the three-way vent valve is configured in the first position, pressure in the evaporative emissions system and fuel system is near atmospheric pressure, indicated by plot 725.

Furthermore, a refueling event is not requested, as the vehicle is in operation, indicated by plot 730. Although the engine is in operation, purge conditions are not met, indicated by plot 740. For example, purge conditions may not be met at time $t_0$ because canister load, indicated by plot 745, is nearly free of adsorbed hydrocarbons. Fuel level is near empty, indicated by plot 735, evaporative emissions test conditions are not indicated to be met, indicated by plot 750, and undesired evaporative emissions are not indicated, illustrated by plot 755.

At time $t_1$, the engine is turned off. In some examples, an engine-off event may include a transition from the vehicle being powered by the combustion engine, to the vehicle being powered solely by battery power. In this example illustration, it may be understood that the engine-off event at time $t_1$ represents a key-off event. As the engine is turned off at time $t_1$, the three-way vent valve is commanded to the second position, thus coupling the fuel vapor canister vent port to the engine intake manifold. As such, fuel vapors that are freed from the fuel vapor canister during the engine-off condition, or fuel vapors that are not adsorbed by the fuel vapor canister, may be directed to engine intake where they may be adsorbed by a second adsorbent (e.g., 224).

At time $t_2$, refueling is requested by the vehicle operator. As described above, a refueling request may comprise vehicle operator depression of a refueling button on a vehicle instrument panel in the vehicle (e.g., refueling button 197), or at a refueling door. In some examples, a refueling request may comprise a refueling operator requesting access to a fuel filler neck, for example, by attempting to open a refueling door, and/or attempting to remove a gas cap. Responsive to the refueling request at time $t_2$, three-way vent valve is maintained in the second position, and the throttle is commanded to an open position. By commanding open the throttle with the three-way vent valve configured in the second position, air flow may be facilitated during the refueling event. Furthermore, as described above, premature shutoffs at the refueling dispensing pump may be avoided.

Between time $t_2$ and $t_3$, fuel level in the fuel tank is indicated to rise, as the refueling operation is conducted. Fuel level rise may be indicated by, for example, via a fuel level sensor, as described above. As fuel is delivered to the fuel tank, fuel in the tank may be agitated, thus resulting in the generation of fuel vapors. With the three-way vent valve commanded in the second position, and the throttle commanded open, fuel vapors may be directed from the fuel tank to the fuel vapor canister for adsorption, prior to being routed to the engine intake manifold. As such, as fuel vapors are routed to the fuel vapor canister during the refueling operation, canister load steadily increases. As mentioned above, canister load may be monitored in some examples, via temperature sensors positioned within the fuel vapor canister.

At time $t_3$, the refueling event is complete. As described above, a refueling event may be indicated to be completed when the fuel level has plateaued for a predetermined duration of time, or responsive to an indication that a refueling nozzle has been removed from the fuel filler neck, an indication that the fuel cap has been replaced, that the refueling door has been closed, etc. As the refueling event is indicated to be complete at time $t_3$, the throttle is commanded to a default position, and the three-way vent valve is maintained in the second position. As such, any fuel vapors not adsorbed by the fuel vapor canister during the refueling event, or any hydrocarbons that are freed from the fuel vapor canister prior to engine-operation, may be routed to the intake manifold where they may be adsorbed by the second adsorbent positioned in the intake manifold.

At time $t_4$, the engine is turned on. As such, the three-way vent valve is commanded to the first position. Commanding the three-way vent valve to the first position while the engine is operating prevents engine intake manifold vacuum from being directed to the canister vent port of the fuel vapor canister. As such, running loss fuel tank vapors during engine-operation may be directed to the fuel vapor canister where they may be adsorbed, prior to exiting to the atmosphere.

At time $t_5$, it is indicated that conditions are met for a fuel vapor canister purging operation. As described above, conditions that may satisfy entry conditions for a purge event may include an engine-on condition with intake manifold vacuum above a threshold, canister load above a threshold, and/or an estimate or measurement of temperature of an emission control device such as a catalyst being above a predetermined temperature associated with catalytic operation commonly referred to as light-off temperature, a non-steady state engine condition, etc. As purge conditions are met at time $t_5$, the three-way vent valve is maintained in the first position, coupling the canister vent port to atmosphere, and the canister purge valve is commanded open. In some cases, commanding open the canister purge valve may include duty cycling the canister purge valve. By commanding open (e.g., duty cycling) the canister purge valve with the three-way vent valve configured in the first position, fresh air may be drawn into the fuel vapor canister, thus promoting the desorption of adsorbed fuel vapor within the canister adsorbent bed. As such, the purge gasses, including desorbed fuel vapor and vapors from the fuel tank, may pass through the purge valve and be directed to the intake manifold and be combusted in the engine.

During the purging operation, canister load is indicated to decline between time $t_5$ and $t_6$. As described above, during purging a learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. One or more exhaust gas oxygen sensors may be positioned in the engine exhaust to provide an estimate of canister load. In other examples, one or more oxygen sensors may be positioned in the engine intake, or coupled to the canister (e.g., downstream of the canister), and/or one or more temperature sensors may be coupled to and/or within the fuel vapor canister, to indicate canister load. Purging may be continued until the stored fuel vapor amount in the canister is below a predetermined threshold canister load.

At time $t_6$, it is indicated that purge conditions are no longer met. For example, the loading state of the canister may be indicated to be below the predetermined threshold canister load, intake manifold vacuum may be above a threshold vacuum level, etc. As such, as canister purge conditions are no longer met at time $t_6$, the canister purge valve is commanded closed. As the engine is still in operation, the three-way vent valve is maintained in the first position, to direct running loss vapors to the fuel vapor canister for adsorption prior to exiting to atmosphere.

Between time $t_6$ and $t_7$, the vehicle is continued to be powered via the engine, and as such fuel level in the fuel tank steadily declines. At time $t_7$, it is indicated that conditions are met for an engine-on evaporative emissions test diagnostic procedure. For example, as described above, entry conditions for an engine-on evaporative emissions test may include an engine intake manifold vacuum above a threshold, a fuel level within a predetermined range, ambient temperature within a predetermined range, vehicle speed within a predetermined range, a threshold time since a previous engine-on evaporative emissions test, an indication that a canister purge operation is not being conducted, etc. As entry conditions are met at time $t_7$, the three-way vent valve is commanded to the third position, thus sealing the canister vent port from atmosphere and from the engine intake manifold. Furthermore, the canister purge valve is commanded to an open position. With the three-way valve in the third position and the canister purge valve commanded open, vacuum from the engine intake manifold may be applied to the evaporative emissions system and fuel system. Accordingly, between time $t_7$ and $t_8$, pressure in the evaporative emissions system and fuel system is indicated to drop. At time $t_8$, a threshold vacuum is indicated to be reached, and accordingly, the canister purge valve is commanded to a closed position. With the canister purge valve commanded closed, and the three-way vent valve configured in the third position, the evaporative emissions system and fuel system may be sealed from atmosphere and from the intake manifold.

Between time $t_8$ and $t_9$, pressure in the fuel system and evaporative emissions system may be monitored. If, during a predetermined duration, pressure in the evaporative emissions system and fuel system does not reach a predetermined threshold pressure level, represented by line 726, it may be indicated that the fuel system and evaporative emissions system are free of undesired evaporative emissions. Accordingly, between time $t_8$ and $t_9$, pressure in the evaporative emissions system and fuel system is not indicated to reach the predetermined pressure threshold, thus undesired evaporative emissions are not indicated, as indicated by plot 755.

At time $t_9$, as undesired evaporative emissions are not indicated and thus the evaporative emissions test diagnostic is completed, it is indicated that entry conditions for the evaporative emissions test are no longer met. As such, the three-way vent valve is commanded to the first position, coupling the fuel vapor canister vent port to atmosphere in order to relieve the vacuum in the evaporative emissions system and fuel system. Accordingly, between time $t_9$ and $t_{10}$, pressure in the fuel system and evaporative emissions system is indicated to return to atmospheric pressure. As the engine is still in operation, the three-way vent valve is maintained in the first position to direct running loss fuel tank vapors to the fuel vapor canister for adsorption prior to exiting to the atmosphere.

At time $t_{11}$, the engine is turned off. The engine-off event may represent a key-off event, or may represent a transition from the vehicle being powered via the engine, to the vehicle being powered solely by battery power. With the engine off, the three-way vent valve is commanded to the second position. As such, during the engine-off condition, the canister vent valve may be coupled to the engine intake, thus directing fuel tank vapors through the fuel vapor canister and then to the engine intake manifold where a second fuel vapor adsorbent is positioned, thus reducing or avoiding bleed emissions during engine-off conditions.

In this way, bleed emissions may be reduced or avoided during engine-off conditions without the addition of a bleed canister positioned in the vent line between the fuel vapor canister vent port and atmosphere. Furthermore, premature shutoffs of a refueling dispenser may be avoided by commanding open an air intake throttle during refueling events, thus facilitating air flow during refueling.

The technical effect is to position a three-way vent valve between the fuel vapor canister vent port and atmosphere, such that the vent port may selectively be coupled to either atmosphere, to engine intake, or sealed from both atmosphere and engine intake. A three-way valve configured as such enables canister purging operations, engine-on and engine-off fuel vapor management, engine-on and engine-off evaporative emissions test diagnostic procedures, and furthermore reduces bleed emissions during engine off conditions without adding a secondary bleed canister. By selectively coupling the canister vent port to the engine intake manifold during engine off conditions while maintaining closed a canister purge valve, fuel tank vapors are routed through the fuel vapor canister for adsorption prior to being routed to the intake manifold, where a second fuel vapor adsorbent is positioned. As such, fuel vapors not adsorbed by the first fuel vapor canister may be adsorbed by the second fuel vapor canister, and any hydrocarbons freed from the fuel vapor canister during engine off conditions, for example due to increased ambient temperatures, may be routed to the second adsorbent for storage prior to exiting to atmosphere. Accordingly, bleed emissions may be avoided, without increased costs and without the potential for restricting refueling efforts.

The systems described herein and with reference to FIGS. 1-3D, along with the methods described herein and with reference to FIGS. 4-6, may enable one or more systems and one or more methods. In one example, a method comprises when an engine is operating, routing vapors from a fuel tank through a purge valve, and routing desorbed vapors from a vapor adsorbent through the purge valve, into the engine for combustion; and when the engine is not operating, changing the routing so that fuel tank vapors are routed through the vapor adsorbent for adsorption and then to an intake manifold of the engine without being routed through the purge valve. In a first example of the method, the method further comprises closing or maintaining closed the purge valve when the engine is not operating. A second example of the method optionally includes the first example and further includes wherein the vapor adsorbent is housed in a fuel vapor canister and further comprising: capturing and storing fuel tank vapors not adsorbed by the fuel vapor canister in the intake manifold of the engine when the engine is not operating. A third example of the method optionally includes any one or more or each of the first and second examples and further includes wherein capturing and storing fuel tank vapors not adsorbed by the fuel vapor canister further comprises: capturing and storing fuel tank vapors in a second vapor adsorbent, the second vapor adsorbent smaller than the adsorbent housed within the canister. A fourth example of the method optionally includes any one or more or each of the first through third examples and further comprises opening the purge valve when the engine is operating under a predetermined set of conditions so that the fuel tank vapors are inducted into the engine, and atmospheric air is inducted across the vapor adsorbent to desorb stored fuel vapors which are then inducted into the engine; and sealing the vapor adsorbent from the engine under another set of predetermined set of conditions while the engine is operating so that fuel tank vapors are routed through the vapor adsorbent for adsorption prior to exiting to atmosphere.

An example of a system for a vehicle comprises a fuel vapor canister comprising: an adsorbent bed and an adsorbent buffer, the adsorbent bed coupled to a canister vent port and the adsorbent buffer coupled to a canister load port and a canister purge port; a fuel tank fluidly connected to the vapor canister adsorbent buffer at the canister load port; a canister purge valve positioned in a first vapor line between the canister purge port and an engine intake manifold of the vehicle; a three-way vent valve positioned in a vent line between the canister vent port and atmosphere, the three-way valve also connected to a second vapor line which in turn is coupled to the intake manifold downstream of the purge valve, the three-way valve having a first position which couples the canister vent port to atmosphere and a second position which couples the canister vent port to the second vapor line and a third position which seals the canister vent port; a controller, holding executable instructions stored in non-transitory memory, that when executed, cause the controller to: responsive to a first condition, direct fuel tank vapors from the fuel tank through the fuel vapor canister to the engine intake manifold by closing the canister purge valve and controlling the three-way vent valve to its second position; and responsive to a second condition, direct fuel tank vapors from the fuel tank through the fuel vapor canister to atmosphere without being directed to the engine intake manifold by closing the canister purge valve and controlling the three-way vent valve to its first position. In a first example, the system further includes wherein the first condition comprises an engine-off condition, and the second condition comprises an engine-on condition. A second example of the system optionally includes the first example and further includes wherein the controller further holds executable instructions stored in non-transitory memory, that when executed, cause the controller to: responsive to the first condition, command or maintain the three-way valve in a second position such that the canister vent port is fluidly coupled to the engine intake manifold via a junction between the canister purge valve and the engine intake manifold; and responsive to the second condition, command or maintain the three-way valve in a first position such that the canister vent port is fluidly coupled to atmosphere to direct fuel tank vapors through the fuel vapor canister to atmosphere. A third example of the system optionally includes any one or more or each of the first and second examples and further comprises an air intake throttle positioned between the engine intake manifold and atmosphere; and wherein the controller is further configured with instructions stored in non-transitory memory, that when executed cause the controller to: responsive to the first condition, command open the throttle. A fourth example of the system optionally includes any one or more or each of the first through third examples and further includes wherein commanding open the throttle comprises a request for refueling of the fuel tank; and wherein the controller is further configured with instructions stored in non-transitory memory, that when executed cause the controller to: return the throttle to a default condition subsequent to completion of refueling the fuel tank. A fifth example of the system optionally includes any one or more or each of the first through fourth examples and further includes wherein the second condition includes engine operation under a predetermined set of conditions; and wherein the controller is further configured with instructions stored in non-transitory memory, that when executed cause the controller to: responsive to another set of predetermined conditions during the second condition, open the canister purge valve and command the three-way vent valve in the first position to induct fuel tank vapors into the engine intake manifold, and to direct atmospheric air across the adsorbent bed to desorb stored fuel vapors which are then inducted into the engine intake manifold for combustion. A sixth example of the system optionally includes any one or more or each of the first through fifth examples and further comprises an air intake system hydrocarbon trap positioned in the engine intake manifold. A seventh example of the system optionally includes any one or more or each of the first through sixth examples and further includes wherein the controller is further configured with instructions stored in non-transitory memory, that when executed cause the controller to: seal the fuel vapor canister and fuel tank from the engine intake manifold and from atmosphere by commanding closed the canister purge valve and commanding the three-way vent valve to a third position. An eighth example of the system optionally includes any one or more or each of the first through seventh examples and further comprising a fuel tank pressure transducer positioned between the fuel tank and the fuel vapor canister; and wherein the controller is further configured with instructions stored in non-transitory memory, that when executed cause the controller to: in the first condition, responsive to predetermined conditions being met, seal the fuel vapor canister and fuel tank from the engine intake manifold and from atmosphere; indicate an absence of undesired evaporative emissions responsive to a pressure build greater than a predetermined threshold; and in the second condition, responsive to predetermined conditions being met, open the canister purge valve while maintaining the three-way vent valve in the third position to draw vacuum on the fuel vapor canister and fuel tank; close the canister purge valve responsive to a vacuum build reaching a predetermined threshold; monitor pressure bleed-up for a predetermined duration; and indicate an absence of undesired emissions responsive to pressure bleed-up lower than a predetermined threshold pressure bleed-up. A ninth example of the system optionally includes any one or more or each of the first through eighth examples and further includes wherein the controller is further configured with instructions stored in non-transitory memory, that when executed cause the controller to: in the first condition, responsive to the pressure build lower than the predetermined threshold; command the three-way vent valve to the second position to depressurize the fuel tank and fuel vapor canister; command the three-way vent valve to the third position responsive to pressure reaching atmospheric pressure; monitor vacuum build for a predetermined duration; and indicate an absence of undesired emissions responsive to vacuum build greater than another threshold vacuum build.

Another example of a method comprises coupling a fuel tank that supplies fuel to an engine to an intake manifold of the engine during engine-off conditions, wherein an engine-off condition includes one or more of a key-off event, or a condition wherein the vehicle is powered solely by energy provided by an onboard energy storage device. In a first example of the method, the method further comprises selectively coupling the intake manifold to atmosphere via an air intake throttle; and commanding open the air intake throttle where the engine-off condition includes a refueling event where fuel is added to the fuel tank. A second example of the method optionally includes the first example and further comprises adsorbing fuel tank vapors in a fuel vapor canister positioned in an evaporative emissions system of the vehicle; and wherein coupling the fuel tank to the intake manifold during engine-off condition routes fuel tank vapors to the fuel vapor canister to be adsorbed therein, prior to being routed to the intake manifold. A third example of the method optionally includes any one or more or each of the first and second examples and further comprises adsorbing fuel tank vapors in an adsorbent material positioned in the engine intake manifold; and wherein coupling the fuel tank to the intake manifold during engine-off conditions reduces bleed emissions from the fuel vapor canister. A fourth example of the method optionally includes any one or more or each of the first through third examples and further selectively coupling the fuel tank to the engine intake manifold via a valve means, the valve means configured to additionally couple the fuel tank to atmosphere during engine-on conditions.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

operating an engine;

when an engine is operating, routing vapors from a fuel tank through a purge valve, and routing desorbed vapors from a vapor adsorbent through the purge valve, into the engine for combustion, the desorbed vapors desorbed from the vapor adsorbent via fresh air routed through a three-way vent valve positioned between the vapor adsorbent and atmosphere;

not operating the engine; and when the engine is not operating, changing the routing so that fuel tank vapors are routed through the vapor adsorbent for adsorption and then to an intake manifold of the engine without being routed through the purge valve, the fuel tank vapors routed from the vapor adsorbent to the intake manifold via the three-way vent valve.

2. The method of claim 1, further comprising:

closing or maintaining closed the purge valve when the engine is not operating, and wherein changing the routing so that fuel vapors are routed through the vapor adsorbent for adsorption and then to the intake manifold without being routed through the purge valve comprises routing the fuel vapors through the vapor adsorbent, through the three-way vent valve, and from the three-way vent valve to the intake manifold via a vapor line that couples to the intake manifold downstream of an intake throttle, and further comprising, during a fuel tank refill event when the engine is not operating, opening the intake throttle.

3. The method of claim 1, wherein changing the routing so that fuel tank vapors are routed through the vapor adsorbent for adsorption and then to the intake manifold of the engine without being routed through the purge valve includes coupling a fuel tank that supplies fuel to the engine to the intake manifold, wherein not operating the engine includes one or more of not operating the engine following a key-off event or not operating the engine while a vehicle in which the engine is installed is powered solely by energy provided by an onboard energy storage device, wherein the vapor adsorbent is housed in a fuel vapor canister, and further comprising:

capturing and storing fuel tank vapors not adsorbed by the fuel vapor canister in the intake manifold of the engine when the engine is not operating.

4. The method of claim 3, wherein capturing and storing fuel tank vapors not adsorbed by the fuel vapor canister further comprises:

capturing and storing fuel tank vapors in a second vapor adsorbent, the second vapor adsorbent smaller than the adsorbent housed within the canister.

5. The method of claim 1, further comprising:

opening the purge valve when the engine is operating under a predetermined set of conditions so that the fuel tank vapors are inducted into the engine, and atmospheric air is inducted across the vapor adsorbent via the three-way vent valve being in a first position to desorb stored fuel vapors which are then inducted into the engine; and sealing the vapor adsorbent from the engine under another set of predetermined conditions while the engine is operating so that fuel tank vapors are routed through the vapor adsorbent for adsorption prior to exiting to atmosphere, the sealing including closing the purge valve and maintaining the three-way vent valve in the first position, and wherein when the engine is not operating, the fuel tank vapors are routed from the vapor adsorbent to the intake manifold via the three-way vent valve in a second position.

6. A system for a vehicle, comprising:

a fuel vapor canister comprising: an adsorbent bed and an adsorbent buffer, the adsorbent bed coupled to a canister vent port and the adsorbent buffer coupled to a canister load port and a canister purge port;

a fuel tank fluidly connected to the vapor canister adsorbent buffer at the canister load port;

a canister purge valve positioned in a first vapor line between the canister purge port and an engine intake manifold of the vehicle;

a three-way vent valve positioned in a vent line between the canister vent port and atmosphere, the three-way valve also connected to a second vapor line which in turn is coupled to the intake manifold downstream of the canister purge valve, the three-way vent valve having a first position which couples the canister vent port to atmosphere a second position which couples the canister vent port to the second vapor line and a third position which seals the canister vent port; and a controller, holding executable instructions stored in non-transitory memory, that when executed, cause the controller to:

responsive to a first condition that includes an engine-off condition, direct fuel tank vapors from the fuel tank through the fuel vapor canister to the engine intake manifold by closing the canister purge valve and controlling the three-way vent valve to its second position; and responsive to a second condition that includes an engine-on condition, direct fuel tank vapors from the fuel tank through the fuel vapor canister to atmosphere without being directed to the engine intake manifold by closing the canister purge valve and controlling the three-way vent valve to its first position.

7. The vehicle system of claim 6, wherein the controller further holds executable instructions stored in non-transitory memory, that when executed, cause the controller to:

responsive to the first condition, command or maintain the three-way valve in the second position such that the canister vent port is fluidly coupled to the engine intake manifold via a junction between the canister purge valve and the engine intake manifold; and responsive to the second condition, command or maintain the three-way vent valve in the first position such that the canister vent port is fluidly coupled to atmosphere to direct fuel tank vapors through the fuel vapor canister to atmosphere.

8. The vehicle system of claim 7, further comprising:

an air intake throttle positioned between the engine intake manifold and atmosphere; and wherein the controller is further configured with instructions stored in non-transitory memory, that when executed cause the controller to:

responsive to the first condition, command open the air intake throttle.

9. The vehicle system of claim 8, wherein commanding open the air intake throttle comprises a request for refueling of the fuel tank; and wherein the controller is further configured with instructions stored in non-transitory memory, that when executed cause the controller to:

return the air intake throttle to a default condition subsequent to completion of refueling the fuel tank.

10. The vehicle system of claim 7, wherein the second condition includes engine operation under a predetermined set of conditions; and wherein the controller is further configured with instructions stored in non-transitory memory, that when executed cause the controller to:

responsive to another set of predetermined conditions during the second condition, open the canister purge valve and command the three-way vent valve in the first position to induct fuel tank vapors into the engine intake manifold, and to direct atmospheric air across the adsorbent bed to desorb stored fuel vapors which are then inducted into the engine intake manifold for combustion.

11. The vehicle system of claim 6, further comprising:

an air intake system hydrocarbon trap positioned in the engine intake manifold.

12. The vehicle system of claim 7, wherein the controller is further configured with instructions stored in non-transitory memory, that when executed cause the controller to:

seal the fuel vapor canister and fuel tank from the engine intake manifold and from atmosphere by commanding closed the canister purge valve and commanding the three-way vent valve to a third position.

13. The vehicle system of claim 12, further comprising:

a fuel tank pressure transducer positioned between the fuel tank and the fuel vapor canister; and wherein the controller is further configured with instructions stored in non-transitory memory, that when executed cause the controller to:

in the first condition, responsive to predetermined conditions being met, seal the fuel vapor canister and fuel tank from the engine intake manifold and from atmosphere; and indicate an absence of undesired evaporative emissions responsive to a pressure build greater than a predetermined threshold; and in the second condition, responsive to predetermined conditions being met, open the canister purge valve while maintaining the three-way vent vent valve in the third position to draw vacuum on the fuel vapor canister and fuel tank;

close the canister purge valve responsive to a vacuum build reaching a predetermined threshold;

monitor pressure bleed-up for a predetermined duration; and indicate an absence of undesired emissions responsive to pressure bleed-up lower than a predetermined threshold pressure bleed-up.

14. The vehicle system of claim 13, wherein the controller is further configured with instructions stored in non-transitory memory, that when executed cause the controller to:

in the first condition, responsive to the pressure build lower than the predetermined threshold, command the three-way vent valve to the second position to depressurize the fuel tank and fuel vapor canister;

command the three-way vent valve to the third position responsive to pressure reaching atmospheric pressure;

monitor vacuum build for a predetermined duration; and indicate the absence of undesired emissions responsive to vacuum build greater than another threshold vacuum build.

15. A method for a vehicle comprising:

coupling a fuel tank that supplies fuel to an engine to an intake manifold of the engine during engine-off conditions, wherein an engine-off condition includes one or more of a key-off event or a condition wherein the vehicle is powered solely by energy provided by an onboard energy storage device, and wherein fuel tank is coupled to the engine via a three-way vent valve during engine-off conditions; and coupling the fuel tank to the intake manifold of the engine via a purge valve during engine-on conditions, the three-way vent valve configured to additionally couple the fuel tank to atmosphere during the engine-on conditions.

16. The method of claim 15, further comprising:

selectively coupling the intake manifold to atmosphere via an air intake throttle; and commanding open the air intake throttle, wherein the engine-off condition includes a refueling event where fuel is added to the fuel tank.

17. The method of claim 15, further comprising:

adsorbing fuel tank vapors in a fuel vapor canister positioned in an evaporative emissions system of the vehicle; and wherein coupling the fuel tank to the intake manifold during engine-off conditions routes fuel tank vapors to the fuel vapor canister to be adsorbed therein, prior to being routed to the intake manifold.

18. The method of claim 17, further comprising:

adsorbing fuel tank vapors in an adsorbent material positioned in the engine intake manifold; and wherein coupling the fuel tank to the intake manifold during engine-off conditions reduces bleed emissions from the fuel vapor canister.

* * * * *